US009372014B2

(12) United States Patent
Nagano et al.

(10) Patent No.: US 9,372,014 B2
(45) Date of Patent: Jun. 21, 2016

(54) EJECTOR-TYPE REFRIGERATION CYCLE DEVICE

(71) Applicant: DENSO CORPORATION, Kariya, Aichi-pref. (JP)

(72) Inventors: Youhei Nagano, Iwakura (JP); Mika Gocho, Obu (JP); Yoshiaki Takano, Kosai (JP); Etsuhisa Yamada, Kariya (JP); Kazunori Mizutori, Toyohashi (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 234 days.

(21) Appl. No.: 14/358,536

(22) PCT Filed: Nov. 15, 2012

(86) PCT No.: PCT/JP2012/007318
§ 371 (c)(1),
(2) Date: May 15, 2014

(87) PCT Pub. No.: WO2013/073185
PCT Pub. Date: May 23, 2013

(65) Prior Publication Data

US 2014/0345318 A1 Nov. 27, 2014

(30) Foreign Application Priority Data

Nov. 17, 2011 (JP) ..... 2011-251426

(51) Int. Cl.
*F25B 1/06* (2006.01)
*F25B 39/02* (2006.01)
(Continued)

(52) U.S. Cl.
CPC . *F25B 1/06* (2013.01); *F25B 39/02* (2013.01); *F25B 41/00* (2013.01); *F25B 5/02* (2013.01);
(Continued)

(58) Field of Classification Search
CPC ..... F25B 41/00; F25B 1/06; F25B 39/02; F25B 5/02; F25B 2341/0011; F25B 2341/0014; F25B 2500/01
USPC ..... 62/500
See application file for complete search history.

(56) References Cited

U.S. PATENT DOCUMENTS 3,447,339 A * 6/1969 Rietdijk ..... F25B 1/10 62/500
6,158,237 A * 12/2000 Riffat ..... B01D 3/007 165/92

(Continued)

FOREIGN PATENT DOCUMENTS

JP 2004-198002 A 7/2004
JP 2007-003171 A 1/2007
JP 2007-024412 A 2/2007

(Continued)

OTHER PUBLICATIONS

International Search Report and Written Opinion of the ISA for PCT/JP2012/007318, ISA/JP, mailed Dec. 25, 2012, with translations thereof.

*Primary Examiner* — Mohammad M Ali
(74) *Attorney, Agent, or Firm* — Harness, Dickey & Pierce, P.L.C.

(57) ABSTRACT

An ejector-type refrigeration cycle device is provided with a first ejector (15) which draws refrigerant from a refrigerant suction port (15*b*, 24*b*) by using a high-speed refrigerant flow jetted from a nozzle part (15*a*, 24*a*), and a first suction-side evaporator (19) connected to the refrigerant suction port (15*b*) of the first ejector (15), and a second suction-side evaporator (27) connected to a refrigerant suction port (24*b*) of a second ejector (24). A flow amount of the refrigerant in the second ejector (24) is smaller than a flow amount of the refrigerant in the first ejector (15). The refrigerant branched at a branch part (Z2) that is positioned on a downstream refrigerant side of a radiator (13) and on an upstream refrigerant side of the first ejector (15) flows into the second ejector (24), and the refrigerant branched on a downstream refrigerant side of the second ejector (24) flows into the second suction-side evaporator (27).

8 Claims, 16 Drawing Sheets

(51) Int. Cl.
*F25B 41/00* (2006.01)
*F25B 5/02* (2006.01)

(52) U.S. Cl.
CPC . *F25B 2341/0011* (2013.01); *F25B 2341/0014* (2013.01); *F25B 2341/0015* (2013.01); *F25B 2500/01* (2013.01)

(56) References Cited

U.S. PATENT DOCUMENTS 6,857,286 B2 * 2/2005 Ohta ..... B60H 1/323 62/498
7,779,647 B2 * 8/2010 Takeuchi ..... F25B 40/00 417/151
2004/0123624 A1 * 7/2004 Ohta ..... B60H 1/323 62/498
2006/0266072 A1 * 11/2006 Takeuchi ..... F25B 40/00 62/500
2010/0313582 A1 * 12/2010 Oh ..... F25B 9/008 62/115
2011/0259039 A1 * 10/2011 Ma ..... F25B 15/02 62/495
2012/0116594 A1 * 5/2012 Aidoun ..... F25B 1/06 700/276
2012/0234026 A1 * 9/2012 Oh ..... F25B 9/008 62/115
2012/0291461 A1 * 11/2012 Verma ..... F25B 41/00 62/115
2013/0111935 A1 * 5/2013 Zou ..... F25B 9/06 62/117

FOREIGN PATENT DOCUMENTS

JP 2007-078318 A 3/2007
JP 2010-048549 A 3/2010

* cited by examiner (a)

(b)

EJECTOR-TYPE REFRIGERATION CYCLE DEVICE

CROSS REFERENCE TO RELATED APPLICATION APPLICATIONS

The current application is a 371 National Phase application based on International Application PCT/JP2012/007318, filed Nov. 15, 2012, which claims priority to Japanese Patent Application 2011-251426 filed on Nov. 17, 2011, the contents of which are incorporated herein by reference in their entirety.

FIELD OF THE INVENTION

The present invention relates to an ejector-type refrigeration cycle device that has an ejector and plural evaporators. The ejector serves as a refrigerant pressure reduction device and also as a refrigerant circulation device.

BACKGROUND OF THE INVENTION

Conventionally, an ejector-type refrigeration cycle device provided with plural ejectors and plural evaporators is known from a patent document 1 or the like. As shown in FIG. 25 in the patent document 1, a first evaporator 16 is connected to a downstream side of a first ejector 15, and an outlet side of a second evaporator 19 is connected to a refrigerant suction port 15*b* of the first ejector 15.

A second ejector 24 is provided for drawing an outlet refrigerant of a third evaporator 27, and the second ejector 24 has its refrigerant suction port 24*b* connected to the outlet side of the third evaporator 27.

A branch passage 22 is provided on an upstream side of the first ejector 15 and branches at a branch part Z, and a high pressure refrigerant on a downstream side of a radiator 13 flows into the second ejector 24 through this branch passage 22. A downstream side of the second ejector 24 is connected to the outlet side of the first evaporator 16.

The first and second evaporators 16 and 19 are constituted as one evaporator unit, and such evaporator unit composed of the first and second evaporators 16 and 19 cools a first cooling object space, and the third evaporator 27 cools a second cooling object space.

The first ejector 15 is disposed exclusively for the evaporator unit composed of the first and second evaporators 16 and 19, and the second ejector 24 is disposed exclusively for the third evaporator 27.

Thereby, a refrigerant flow amount of the evaporator unit and a refrigerant flow amount of the third evaporator 27 can be appropriately adjusted with an exclusive ejector, respectively.

Since the refrigerant is branched into a second ejector 24 side and into a third evaporator 27 side at a branch part X disposed on an upstream side of the second ejector 24, the refrigerant flow amount which flows into the second ejector 24 becomes small. Therefore, it is necessary to form a nozzle part 24*a* of the second ejector 24 to have a small size, and a degree of difficulty of manufacturing the nozzle part 24*a* with high processing accuracy may be further increased. In FIG. 25, corresponding components of the drawing corresponding to an embodiment of the present disclosure have the same reference numerals, for saving the detailed explanation thereof.

PRIOR ART DOCUMENT

Patent Document

Patent document 1: Japanese Unexamined Patent Publication No. 2007-24412

SUMMARY OF THE INVENTION

In view of the foregoing matters describing above, it is an objective of the present disclosure to provide an ejector-type refrigeration cycle device in which a readily-manufacturable second ejector may be used.

According to a first aspect of the present disclosure, an ejector-type refrigeration cycle device includes: a compressor discharging a refrigerant; a radiator which cools the refrigerant discharged from the compressor; a first ejector and a second ejector, each of which draws the refrigerant from a refrigerant suction port by using a high-speed refrigerant flow jetted from a nozzle part; a first suction-side evaporator connected to the refrigerant suction port of the first ejector; and a second suction-side evaporator connected to the refrigerant suction port of the second ejector. In the ejector-type refrigeration cycle device, a flow amount of the refrigerant in the second ejector is smaller than a flow amount of the refrigerant in the first ejector. Furthermore, the refrigerant branched at a branch part that is positioned on a downstream refrigerant side of the radiator and on an upstream refrigerant side of the first ejector flows into the second ejector, and the refrigerant branched on a downstream refrigerant side of the second ejector flows into the second suction-side evaporator.

Thus, the refrigerant is not branched, on the upstream side of the second ejector, to a side of the second ejector and to a side of the second suction-side evaporator, and thereby the refrigerant flow amount in the second ejector can be increased as compared with a case where the refrigerant is branched to the side of the second ejector and to the side of the second suction-side evaporator on the upstream side of the second ejector. Therefore, the nozzle part may have a large size, thereby making it possible to use the readily-manufacturable second ejector in the refrigeration cycle device.

According to a second aspect of the present disclosure, an ejector-type refrigeration cycle device includes: a compressor discharging a refrigerant; a radiator which cools the refrigerant discharged from the compressor; a first ejector and a second ejector, each of which draws the refrigerant from a refrigerant suction port by using a high-speed refrigerant flow jetted from a nozzle part; a first suction-side evaporator connected to the refrigerant suction port of the first ejector; and a second suction-side evaporator connected to the refrigerant suction port of the second ejector. In the ejector-type refrigeration cycle device, a flow amount of the refrigerant in the second ejector is smaller than a flow amount of the refrigerant in the first ejector. Furthermore, the refrigerant branched at a branch part that is positioned on a downstream refrigerant side of the compressor and on an upstream refrigerant side of the radiator flows into the second ejector, and the refrigerant branched on a downstream refrigerant side of the radiator and on an upstream refrigerant side of the first ejector flows into the second suction-side evaporator.

Since a gas phase refrigerant with a low density, discharged from the compressor, flows into the second ejector, the nozzle part of the second ejector may have a large size as compared with a case where a liquid phase refrigerant with a high density flows. Therefore, the readily-manufacturable second ejector may be used.

In an ejector-type refrigeration cycle device according to a third aspect of the present disclosure, the second ejector may have a double cylinder structure which has an inner cylinder and an outer cylinder. In this case, a suction flow drawn from the refrigerant suction port may flow through a flow passage formed in an inside of the inner cylinder, and a drive flow jetted from the nozzle part may flow through a flow passage formed in a space between the inner cylinder and the outer cylinder.

Since a width dimension of the flow passage through which the suction flow flows is expandable as compared with a case where the suction flow flows through the inside of the inner cylinder, the manufacturing of the second ejector can be made easy.

In an ejector-type refrigeration cycle device according to a fourth aspect of the present disclosure, the second ejector may be configured such that the nozzle part of the second ejector is formed at one end portion of a cylindrical member, and a mixing part and a diffuser part of the second ejector are formed at an other end portion of the cylindrical member. Furthermore, the mixing part may mix the high-speed refrigerant flow jetted from the nozzle part and a suction refrigerant drawn from the refrigerant suction port, the diffuser part may reduce a speed of the refrigerant mixed in the mixing part and may increase a pressure of the refrigerant mixed in the mixing part, and the nozzle part and the mixing part may be connected smoothly.

In this case, as compared with a case where the second ejector has a double cylinder structure, the structure of the second ejector is simplified thereby improving the ease of manufacturing thereof.

An ejector-type refrigeration cycle device according to a fifth aspect of the present disclosure may further include a throttle mechanism decompressing the refrigerant which flows into the second suction-side evaporator. In this case, the throttle mechanism may have a structure swirling the refrigerant flowing therein.

In such manner, a state where the gas phase refrigerant is abundant on an inner side of the swirl than on an outer side of the swirl is realized. For this reason, as compared with a case where the refrigerant is not swirled, the refrigerant flow amount flowing out from the throttle mechanism is decreased.

DETAILED DESCRIPTION OF THE PREFERRED EMBODIMENTS

Figure 1:
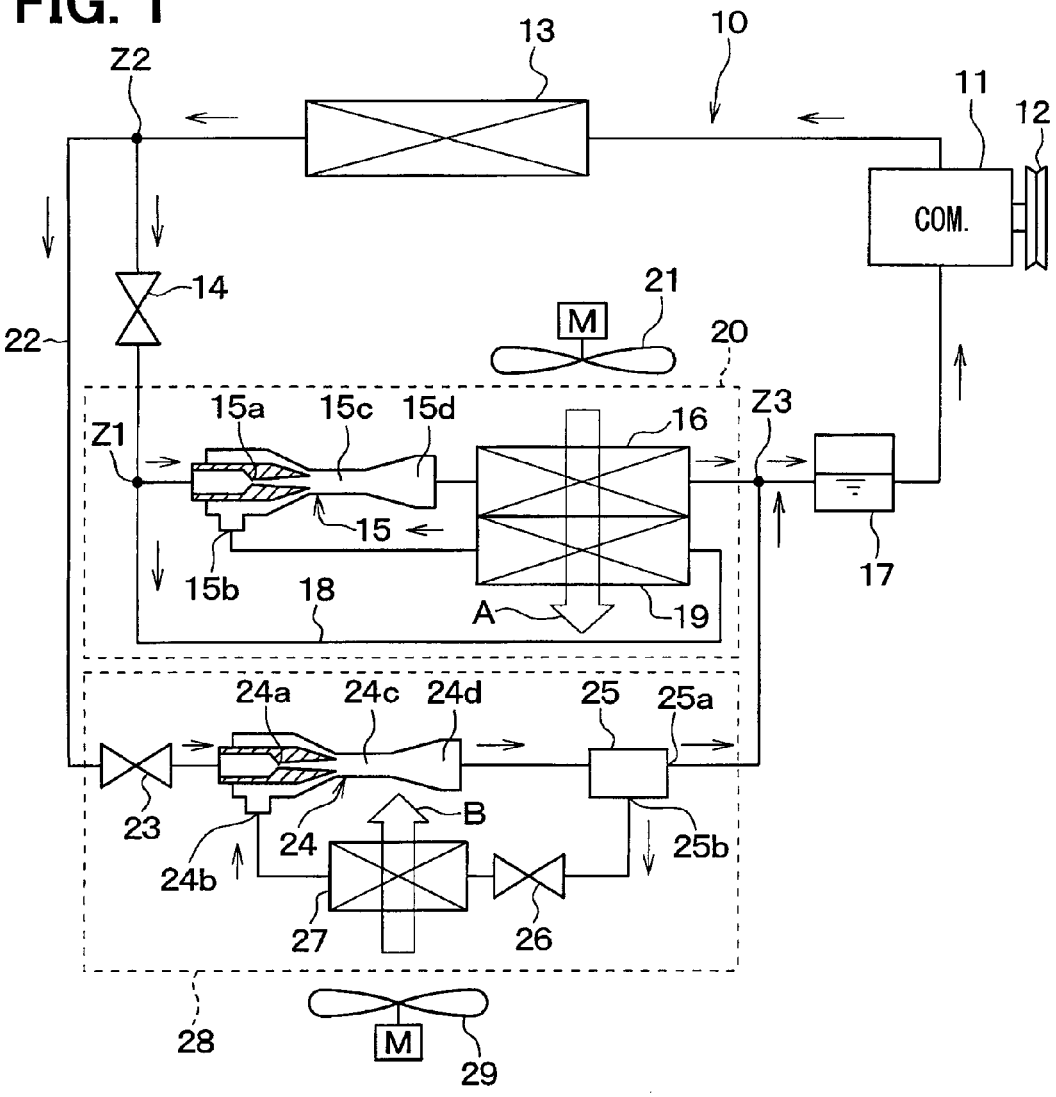
FIG. 1 is a cycle configuration diagram of an ejector-type refrigeration cycle device in a first embodiment.

In the following, plural embodiments for realizing the present disclosure are explained with reference to the drawings. In the plural embodiments, the same reference numerals may be assigned to the same parts in the preceding embodiment, for avoiding redundant explanations and for the brevity of the description. When a part of an embodiment is explained, explanation of the other part of the same embodiment is left to at least one of the preceding embodiments. A partial combination of plural embodiments may be considered to be within the scope of the present disclosure not necessarily for an explicitly-described case but also for a non-explicitly-described case unless such combination has a hindrance thereof.

First Embodiment

FIG. 1 shows an example in which an ejector-type refrigeration cycle device 10 of the first embodiment is used for a refrigeration cycle device for vehicles. In the ejector-type refrigeration cycle device 10 of the present embodiment, a compressor 11 which draws and compresses a refrigerant is rotatingly driven by a non-illustrated vehicle use engine via a pulley 12, a belt, and the like.

As such compressor 11, a variable capacity type compressor which adjusts its refrigerant discharge capacity by changing a discharge volume may be used or a fixed capacity type compressor which adjusts a refrigerant discharge capacity by changing an operation ratio of a compressor operation based on connection and disconnection of an electromagnetic clutch may be used. Further, if an electrically-driven compressor is used as the compressor 11, the refrigerant discharge capacity can be adjusted by adjusting the number of rotations of an electric motor.

A radiator 13 is disposed on a refrigerant discharge side of the compressor 11. The radiator 13 performs heat exchange between the high pressure refrigerant discharged from the compressor 12 and an outside air (i.e., air outside a passenger compartment) blown by a cooling fan which is not illustrated, and cools the high pressure refrigerant.

Here, when a usual fluorocarbon refrigerant is used as a refrigerant of the ejector-type refrigeration cycle device 10, the radiator 13 is used as a condenser which cools and condenses the refrigerant, because a subcritical cycle is formed in which the high pressure does not exceed a critical pressure of the refrigerant. On the other hand, when a carbon dioxide (CO2) or the like is used as the refrigerant, the refrigerant simply radiates heat in a supercritical state, thereby not being condensed, because a supercritical cycle is formed in which the high pressure of such refrigerant exceeds the critical pressure. Hereafter, a subcritical cycle in which the radiator 13 acts as a condenser is taken as an example for the explanation of the present embodiment.

A throttle mechanism 14 is disposed at a downstream side portion of the refrigerant flow relative to the radiator 13, and a first ejector 15 is disposed at a downstream side portion of the throttle mechanism 14.

The throttle mechanism 14 is a pressure reduction device which adjusts a flow amount of the refrigerant, and may be specifically consist of a fixed diaphragm like a capillary tube or an orifice. An electric control valve in which a valve opening degree (i.e., a throttle opening degree of a passage) is adjusted by an electric actuator may also be used as the throttle mechanism 14.

The first ejector 15 serves as a refrigerant circulation device (i.e., a momentum transfer type pump) which circulates the refrigerant with a suction effect of the refrigerant flow jetted at a high speed while serving as a pressure reduction device which decompresses the refrigerant.

In the first ejector 15, there is provided with (i) a nozzle part 15*a* which reduces a passage area size of an intermediate pressure refrigerant which flows in from the throttle mechanism 14 and decompresses and expands the intermediate pressure refrigerant iso-entropically and (ii) a refrigerant suction port 15*b* which is disposed in connection with a refrigerant jetting port of the nozzle part 15*a* and draws the refrigerant from a second evaporator 19 mentioned later.

Further, in a downstream side portion of the nozzle part 15*a* and the refrigerant suction port 15*b*, a mixing part 15*c* which mixes the high-speed refrigerant flow which is jetted from the nozzle part 15*a* and the suction refrigerant of the refrigerant suction port 15*b* is disposed. Further, on a downstream side of the mixing part 15*c*, a diffuser part 15*d* which serves as a pressure boost part is disposed. The diffuser part 15*d* is formed in a shape in which a refrigerant passage area size is gradually increased toward downstream, and achieves a refrigerant pressure boosting effect by reducing a speed of the refrigerant flow, that is, in other words, achieves an energy conversion effect for converting a speed energy of the refrigerant to a pressure energy.

A first evaporator 16 is connected to a downstream side of the diffuser part 15*d* of the first ejector 15, and a gas-liquid separator 17 is connected to a refrigerant flow downstream side of this first evaporator 16. The refrigerant flow downstream side of the gas-liquid separator 17 is connected to a suction side of the compressor 11.

On the other hand, a first branch passage 18 branches from a branch part Z1 positioned in an upstream part of the first ejector 15 (i.e., an intermediate part between the throttle mechanism 14 and the first ejector 15), and the downstream side of this first branch passage 18 is connected to the refrigerant suction port 15*b* of the first ejector 15. A second evaporator 19 (i.e., a first suction-side evaporator) is disposed in this first branch passage 18.

In the present embodiment, the two evaporators 16 and 19 and the first ejector 15 are combined to have a one-body structure, and the two evaporators 16 and 19 and the first ejector 15 consist of an evaporator unit 20 in the one-body structure. Although there may be various examples of how such one-body structure is made, which combines the two evaporators 16 and 19 and the first ejector 15, a soldering structure which combines the two evaporators 16 and 19 and the first ejector 15 by soldering may be preferable from a productivity improvement view point.

That is, flat shape tubes which constitute the refrigerant passage of the two evaporators 16 and 19 (not shown), corrugated fins alternatingly layered with the flat shape tubes (not shown), tank parts distributing and collecting to and from many tubes (not shown) and other parts are formed by using metal such as aluminum, and, each of those parts of the two evaporators 16 and 19 and the first ejector 15 are assembled temporarily in a predetermined structure, and the temporarily assembled structure is brought into a heat furnace, and each of those parts of the two evaporators 16 and 19 and the first ejector 15 are combined to have one body by soldering.

An evaporator unit 20 which is a one-body combination of the two evaporators 16 and 19 and the first ejector 15 is stored in an in-compartment unit case (not shown) of an air-conditioner for vehicles. Further, an air passage that is defined in the indoor unit case receives air (i.e., a cooling object air) that is blown by an electric blower 21 as indicated by an arrow A, and this blown air is cooled by the two evaporators 16 and 19.

A cold wind cooled by the two evaporators 16 and 19 is sent into the same cooling object space, more practically, into an in-vehicle passenger compartment space (not shown), and, in such manner, the passenger compartment space is air-conditioned by the two evaporators 16 and 19. Here, from among the two evaporators 16 and 19, the first evaporator 16 connected to the downstream side flow passage of the first ejector 15 is disposed on an upstream side of an air flow A, the second evaporator 19 connected to the refrigerant suction port 15*b* of the first ejector 15 is disposed on the downstream side of the air flow A.

On the other hand, the second branch passage 22 branches from a branch part Z2 positioned in an upstream part of the throttle mechanism 14 (i.e., an intermediate portion between the radiator 13 and the throttle mechanism 14), and a downstream side of this second branch passage 22 is connected to a merge part Z3 positioned on an outlet side of the first evaporator 16.

The second branch passage 22 also has a throttle mechanism 23 disposed therein, and the second ejector 24 is disposed in a downstream side portion of this throttle mechanism 23. The throttle mechanism 23 is a pressure reduction device which adjusts the refrigerant flow amount, and may be specifically consist of a fixed diaphragm like a capillary tube or an orifice. An electric control valve in which a valve opening degree (i.e., a throttle opening degree of a passage) is adjusted by an electric actuator may also be used as the throttle mechanism 23.

The second ejector 24 serves as a refrigerant circulation device (i.e., a momentum transfer type pump) which circulates the refrigerant with the suction operation of the refrigerant flow jetted at a high speed while serving as a pressure reduction device which decompresses the refrigerant.

In the second ejector 24, there is provided with (i) a nozzle part 24*a* which reduces a passage area size of an intermediate pressure refrigerant which flows in from the throttle mechanism 23 and decompresses and expands the intermediate pressure refrigerant iso-entropically, and (ii) a refrigerant suction port 24*b* which is in connection with a refrigerant jetting port of the nozzle part 24*a* and draws the refrigerant from a third evaporator 27 mentioned later.

Further, in a downstream side portion of the nozzle part 24*a* and the refrigerant suction port 24*b*, a mixing part 24*c* which mixes the high-speed refrigerant flow which is jetted from the nozzle part 24*a* and the suction refrigerant of the refrigerant suction port 24*b* is disposed. Further, on a downstream side of the mixing part 24*c*, a diffuser part 24*d* which serves as a pressure boost part is disposed. The diffuser part 24*d* is formed in a shape in which a refrigerant passage area size is gradually increased, and achieves a refrigerant pressure boosting effect by reducing a speed of the refrigerant flow, that is, in other words, achieves an energy conversion effect for converting a speed energy of the refrigerant to a pressure energy.

A refrigerant distributor 25 is connected to a downstream side of the diffuser part 24*d* of the second ejector 24. The refrigerant distributor 25 provides a vapor-liquid separation function for separating gas from liquid by swirling the refrigerant, a liquid pool function for pooling a separated liquid-phase refrigerant, and a refrigerant distribution function which flows a high dryness refrigerant (i.e., a gas phase rich refrigerant) to flow toward a first outlet 25*a* and flows a low dryness refrigerant (i.e., a liquid phase rich refrigerant) to flow toward a second outlet 25*b*.

The first outlet 25*a* of the refrigerant distributor 25 is connected to the merge part Z3 positioned on the outlet side of the first evaporator 16. The second outlet 25*b* of the refrigerant distributor 25 is connected to a throttle mechanism 26. In such manner, an outlet side refrigerant of the second ejector 24 is separated into gas and liquid by the refrigerant distributor 25, flowing a liquid-phase refrigerant into the throttle mechanism 26 and flowing the gas-phase refrigerant into the compressor 11. Therefore, returning of a liquid refrigerant back into the compressor 11 is securely prevented.

A refrigerant flow downstream side of the throttle mechanism 26 is connected to the third evaporator 27 (i.e., a second suction-side evaporator). Further, a refrigerant flow downstream side of the third evaporator 27 is connected to the refrigerant suction port 24*b* of the second ejector 24.

In the present embodiment, the third evaporator 27, the second ejector 24, the refrigerant distributor 25, and the throttle mechanism 26 are assembled to have a one-body structure, and the third evaporator 27, the second ejector 24, the refrigerant distributor 25, and the throttle mechanism 26 consist of an evaporator unit 28 in the one-body structure.

Although there may be various examples of how such one-body structure is made, which combines the third evaporator 27, the second ejector 24, the refrigerant distributor 25 and the throttle mechanism 26; a soldering structure which combines the third evaporator 27, the second ejector 24, the refrigerant distributor 25, and the throttle mechanism 26 by soldering may be preferable from a productivity improvement view point.

That is, flat shape tubes which constitute the refrigerant passage of the third evaporator 27 (not shown), corrugated fins alternatingly layered with the flat shape tubes (not shown), tank parts distributing and collecting to and from many tubes (not shown) and other parts are formed by using metal such as aluminum, and, each of those parts of the third evaporator 27, the second ejector 24, the refrigerant distributer 25 and the throttle mechanism 26 are assembled temporarily in a predetermined structure, and the temporarily assembled structure is brought into a heat furnace, and each of those parts of the third evaporator 27, the second ejector 24, the refrigerant distributer 25 and the throttle mechanism 26 are combined to have one body by soldering.

The evaporator unit 28 which is a one-body combination of the third evaporator 27, the second ejector 24, the refrigerant distributor 25, and the throttle mechanism 26 is disposed in an in-vehicle refrigerator (not shown) that is installed in an in-vehicle passenger compartment, and cools an inner space of the in-vehicle refrigerator with the third evaporator 27. More specifically, an electric blower 29 which blows an inner space air to the third evaporator 27 is disposed in an inside of the in-vehicle refrigerator, and the blown air from the electric blower 29 is cooled by the third evaporator 27, and a cold wind is blown into the inner space of the in-vehicle refrigerator.

Figure 2:
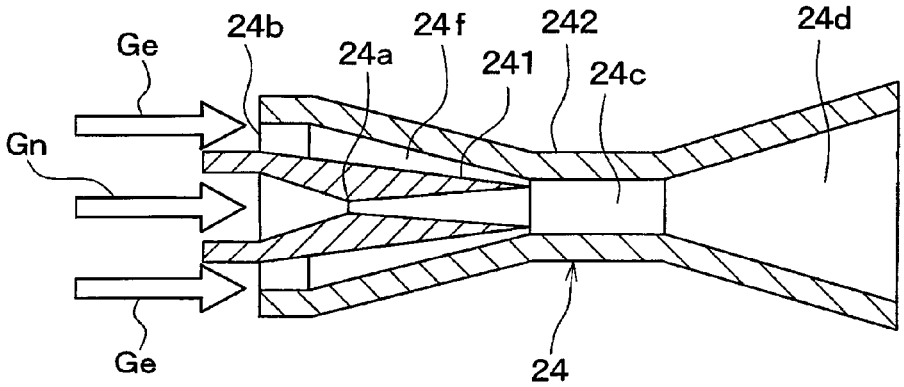
FIG. 2 is a sectional view of a second ejector in the first embodiment.

Next, a concrete structure of the second ejector 24 is explained based on FIG. 2. The second ejector 24 has a double cylinder structure, with an inner cylinder 241 forming the nozzle part 24*a* and an outer cylinder 242 forming the mixing part 24*c* and the diffuser part 24*d*. The refrigerant suction port 24*b* is formed on the outer cylinder 242.

Therefore, an intermediate pressure refrigerant Gn which flows in from the throttle mechanism 23 (i.e., henceforth designated as a drive flow) flows through a flow passage formed in an inside of the inner cylinder 241 of the second ejector 24, a refrigerant Ge from the third evaporator 27 (i.e., henceforth designated as a suction flow) flows through a flow passage formed in a space between the outer cylinder 242 and inner cylinder 241 of the second ejector 24.

The nozzle part 24*a* is formed with metal, takes an approximately cylindrical shape and has a taper-shaped tip part that points to a flow direction of the refrigerant. Further, the nozzle part 24*a* is formed to change the refrigerant passage area size in an inside thereof to decompress the refrigerant in an equi-entropic manner.

More specifically, the refrigerant passage formed in an inside of the nozzle part 24*a* has a tapered space in which the refrigerant passage area size gradually decreases toward a downstream side from an upstream side of the refrigerant flow, and a throttle part at a tip of the tapered space where the refrigerant passage area size is smallest, and a widening part in which the refrigerant passage area size gradually expands toward a downstream side of the refrigerant flow from the throttle part.

In other words, the nozzle part 24*a* of the present embodiment is formed as a Laval nozzle, and makes a flow speed of the refrigerant in the throttle part to exceed a sonic speed. Of course, the nozzle part 24*a* may be formed as a tapered nozzle. Further, at the tip of the widening part of the nozzle part 24*a*, a refrigerant jetting port for jetting the refrigerant is formed.

The outer cylinder 242 is formed with metal, and takes an approximately cylindrical shape, just like the nozzle part 24*a*, and, in an inside thereof, an accommodation space 24*f* in which the nozzle part 24*a* is accommodated and a diffuser part 24*d* are formed.

The accommodation space 24*f* is formed as a cylindrical space which extends in an axial direction of the nozzle part 24*a* from a refrigerant flow upstream side and a tapered space which has a cross-section area that is perpendicular to the axial direction of the nozzle part 24*a* gradually decreased toward the refrigerant flow direction from the cylindrical space, so that the accommodation space 24*f* is fitted to an outside shape of the nozzle part 24*a*.

On the other hand, the diffuser part 24*d* is a space which has a cross-section area that is perpendicular to the axial direction of the nozzle part 24*a* gradually increased toward the refrigerant flow direction. The refrigerant suction port 24*b* is formed in the outer cylinder 242.

Figure 3:
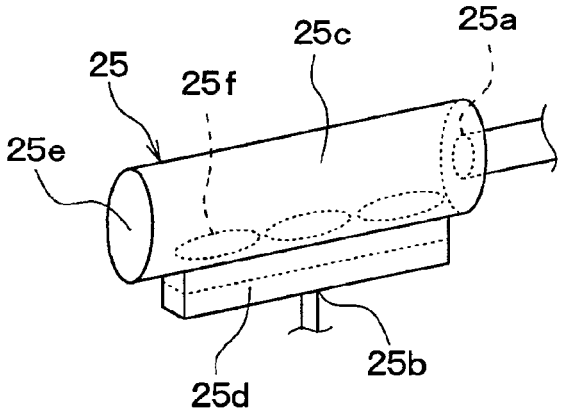
FIG. 3 is a perspective view of a refrigerant distributor in the first embodiment.

Next, a concrete structure of the refrigerant distributor 25 is explained based on FIG. 3. The refrigerant distributor 25 has a swirl part 25*c* which separates the refrigerant by swirling into gas and liquid and a liquid pool part 25*d* which pools the liquid-phase refrigerant separated at the swirl part 25*c*.

The swirl part 25*c* has an inlet 25*e* into which the refrigerant flows and the first outlet 25*a* from which the high dryness refrigerant (i.e., a gas phase rich refrigerant) flows out formed thereon. The liquid pool part 25*d* has the second outlet 25*b* from which the low dryness refrigerant (i.e., a liquid phase rich refrigerant) flows out formed thereon.

The swirl part 25*c* is formed in a cylindrical shape extending horizontally, with one end of which having the inlet 25*e* of the refrigerant formed thereon, and with the other end of which the first outlet 25*a* formed thereon. The liquid pool part 25*d* is positioned at a lower side of the swirl part 25*c*. The liquid pool part 25*d* is in communication with the swirl part 25*c* via a communication opening 25*f*.

That is, the flow direction of the swirling refrigerant in the refrigerant distributor 25 is the same as an inflow direction of the refrigerant flowing in from the inlet 25*e*. Further, the refrigerant distributor 25 may be provided as an accumulator in which the flow direction of the swirling refrigerant is perpendicular to the inflow direction of the refrigerant. In such an accumulator, a swirl part which swirls the refrigerant is formed at least in a vertically-extending cylindrical shape, and the inlet of the refrigerant is formed at least in an upper part of the swirl part.

Figure 4:
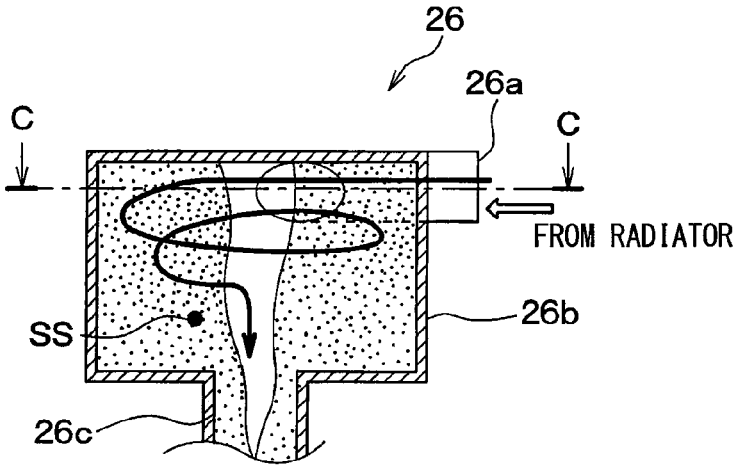
FIG. 4 (*a*) is a sectional view of a throttle mechanism in the first embodiment, and FIG. 4 (*b*) is a sectional view taken along the C-C line in FIG. 4 (*a*)
Figure 4:
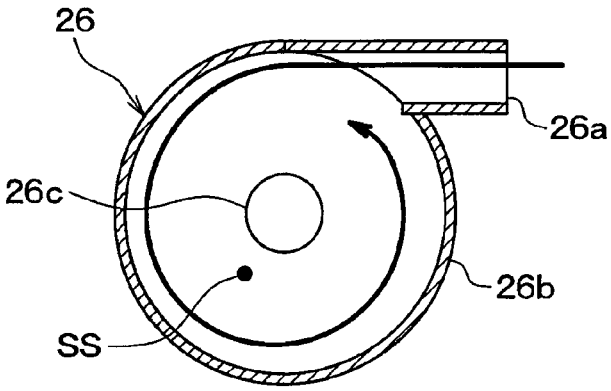

Next, a concrete configuration of the throttle mechanism 26 is explained based on FIG. 4. FIG. 4 (*a*) is an axial direction sectional view of the throttle mechanism 26, and FIG. 4 (*b*) is a sectional view taken along the C-C line in FIG. 4 (*a*).

The throttle mechanism 26 is provided with a body part 26*b* which forms in an inside of a swirl space SS which swirls the refrigerant flowing in from a refrigerant inflow opening 26*a*. The body part 26*b* is formed as a hollow container made with metal, an outer shape of which is an approximate column shape. The swirl space SS formed in an inside of the body part 26*b* includes a column shape space that is fitted to an outer shape of the body part 26*b*.

The refrigerant inflow opening 26*a* is formed as a side of one axial end (i.e., an upper side of FIG. 4 (*a*)) among other sides of the body part 26*b*, and, when it is seen from the upper side, as shown in FIG. 4 (*b*), the inflow direction of the refrigerant flowing into the swirl space SS and a tangent direction of the substantially circular swirl space SS on the perpendicular cross section that is perpendicular to the axis of the swirl space SS match with each other.

Thereby, as shown by a thick line arrow in FIGS. 4 (*a*)/(*b*), the refrigerant flowing in from the refrigerant inflow opening 26*a* flows along an inner wall surface of the body part 26*b*, and swirls in an inside of the swirl space SS. Further, it is not necessary for the refrigerant inflow opening 26*a* to flow the refrigerant in an inflow direction which completely matches the tangent direction of the circular swirl space SS on the perpendicular cross section that is perpendicular to the axis of the swirl space SS, that is, the inflow direction may have an axial direction component as long as it includes a tangent direction component.

A refrigerant outlet 26*c* is formed on the other axial end of the axis of the body part 26*b* (i.e., a lower side of FIG. 4 (*a*)), and an outflow direction of the refrigerant which flows out from the swirl space SS is positioned to be substantially same as the axial direction of the swirl space SS.

The refrigerant passage cross-section area size of the refrigerant outlet 26*c* is smaller than the cross-section area size of the swirl space SS. Therefore, the refrigerant outlet 26*c* achieves a fixed throttle function which decompresses the refrigerant by decreasing the refrigerant passage area size.

Since a centrifugal force acts on the refrigerant which swirls in the swirl space SS, when a gas-liquid two phase refrigerant flows in from the refrigerant inflow opening 26*a*, a liquid phase refrigerant having a high density is unevenly distributed on an outer side relative to a center of the swirl. Therefore, when a gas-liquid two phase refrigerant flows in from the refrigerant inflow opening 26*a*, the gas phase refrigerant is abundant on an inner side rather than the outer side relative to a center line of swirl.

Further, according to the effect of the above-mentioned centrifugal force, the refrigerant pressure near the center of the swirl becomes lower than the pressure of the outer side. Since the refrigerant pressure near the center of the swirl lowers as the centrifugal force increases, the refrigerant pressure near the center of the swirl decreases as the swirl speed of the refrigerant which swirls in the swirl space SS increases.

Therefore, by sufficiently increasing the swirl speed and by causing a decompression boiling of the refrigerant, the gas phase refrigerant rich state is realized on the inner side than on the outer side relative to the center of the swirl, even when the liquid phase refrigerant flows in from the refrigerant inflow opening 26*a*. Therefore, in comparison to a case where the refrigerant is not swirled in the swirl space SS, the refrigerant flow amount flowing out from the refrigerant outlet 26*c* is decreased.

Figure 5:
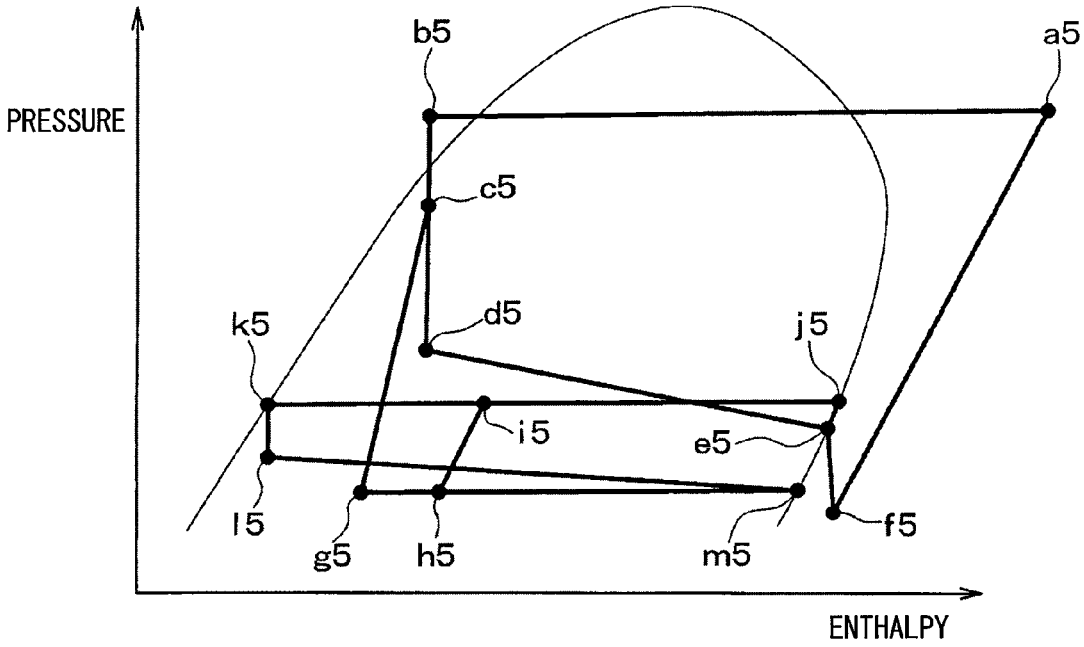
FIG. 5 is a Mollier diagram showing refrigerant states in the refrigerant cycle device in the first embodiment.

Next, the operation of the first embodiment is explained based on the Mollier diagram in FIG. 5. When the compressor 11 is driven by a vehicle engine, the compressor 11 compresses and discharges the refrigerant as a high pressure refrigerant (i.e., the a5 point in FIG. 5) after drawing the refrigerant. The gas phase refrigerant in a high temperature and high pressure state discharged from the compressor 11 flows into the radiator 13. In the radiator 13, the high temperature refrigerant is cooled by the outside air and condenses (i.e., the a5 point→the b5 point). The high-pressure liquid phase refrigerant flowing out from the radiator 13 is split into a refrigerant flow which flows toward the throttle mechanism 14 and a refrigerant flow which flows toward the second branch passage 22 at the branch part Z2.

The refrigerant flow which flows toward the throttle mechanism 14 from the branch part Z2 is decompressed by the throttle mechanism 14, and serves as an intermediate pressure refrigerant (i.e., the b5 point→the c5 point), and this intermediate pressure refrigerant is, at the branch part Z1, split into a refrigerant flow which flows toward the first ejector 15 and a refrigerant flow which flows toward the first branch passage 18.

The refrigerant flow which has flown into the first ejector 15 is decompressed by the nozzle part 15*a*, and expands (i.e., the c5 point→the d5 point). Therefore, a pressure energy of the refrigerant is converted to a speed energy by the nozzle part 15*a*, and the refrigerant is jetted from a jetting opening of the nozzle part 15*a* at a high speed. Due to the decrease of the refrigerant pressure at such time, the refrigerant that has passed through the second evaporator 19 in the first branch passage 18 is drawn from the refrigerant suction port 15*b*.

The refrigerant which jetted from the nozzle part 15*a* and the refrigerant drawn from the refrigerant suction port 15*b* are mixed at the mixing part 15*c* on the downstream side of the nozzle part 15*a*, and flows into the diffuser part 15*d*. In the diffuser part 15*d*, due to the expansion of the passage area size, a speed (i.e., an expansion) energy of the refrigerant is converted to a pressure energy, thereby causing arise of the refrigerant pressure.

Then, the refrigerant flowing out from the diffuser part 15*d* of the first ejector 15 joins the refrigerant which has flown out from the refrigerant distributor 25 at the merge part Z3 that has passed through the first evaporator 16. In the first evaporator 16, a low temperature low pressure refrigerant absorbs heat from the blown air that flows along the arrow A direction and evaporates.

The refrigerant which has joined at the merge part Z3 is separated into gas and liquid by the gas-liquid separator 17 (i.e., the d5 point→the e5 point), and the separated gas phase refrigerant is drawn by the compressor 11 (i.e., the e5 point→the f5 point), and is compressed again (i.e., the f5 point→the a5 point).

On the other hand, the refrigerant flow which has flown into the first branch passage 18 flows into the second evaporator 19. In the second evaporator 19, a low pressure refrigerant absorbs heat from the blown air along the arrow A direction, and evaporates (omitted from FIG. 5). The refrigerant after this evaporation is drawn into the first ejector 15 from the refrigerant suction port 15*b* (omitted from FIG. 5).

Further, the refrigerant flow which has been split at the branch part Z2 and has flown into the second branch passage 22 is decompressed by the throttle mechanism 23, and serves as an intermediate pressure refrigerant, and this intermediate pressure refrigerant flows into the second ejector 24 (i.e., the c5 point→the g5 point).

The refrigerant flow which has flown into the second ejector 24 is decompressed by the nozzle part 24*a*, and expands. Therefore, a pressure energy of the refrigerant is converted to a speed energy by the nozzle part 24*a*, and is jetted from the jetting opening of the nozzle part 24*a* at a high speed. Due to the decrease of the refrigerant pressure in this case, the refrigerant that has passed through the third evaporator 27 is drawn from the refrigerant suction port 24*b*.

The refrigerant which is jetted from the nozzle part 24*a* and the refrigerant drawn by the refrigerant suction port 24*b* are mixed at the mixing part 24*c* on the downstream side of the nozzle part 24*a* and flow into the diffuser part 24*d* (i.e., the g5 point→the h5 point). In the diffuser part 24*d*, by an expansion of the passage area size, a speed (i.e., an expansion) energy of the refrigerant is converted to a pressure energy, thereby causing a rise of the refrigerant pressure (i.e., the h5 point→the i5 point).

Then, the refrigerant which has flown out from the diffuser part 24*d* flows into the refrigerant distributor 25. In the refrigerant distributor 25 the refrigerant flowing out from the diffuser part 24*d* is separated into gas and liquid (i.e., the i5 point→the j5 point, the i5 point→the k5 point). The refrigerant separated by the refrigerant distributor 25 joins the refrigerant which has flown out from the first evaporator 16 at the merge part Z3 (i.e., the j5 point→the e5 point).

On the other hand, the liquid phase refrigerant separated by the refrigerant distributor 25 is decompressed by the throttle mechanism 26, and it becomes a low pressure refrigerant (i.e., the k5 point→the l5 point), and the low pressure refrigerant decompressed by the throttle mechanism 26 flows into the third evaporator 27. In the third evaporator 27, a low pressure refrigerant absorbs heat from the blown air B from the electric blower 29 and evaporates (i.e., the l5 point→the m5 point). The refrigerant after this evaporation is drawn into the second ejector 24 from the refrigerant suction port 24*b* (i.e., the m5 point→the h5 point). The blown air B which became a cold wind by the heat absorption in the third evaporator 27 is blown into the inner space of the in-vehicle refrigerator (not shown).

As described above, since, in the present embodiment, the refrigerant on the downstream side of the diffuser part 15*d* of the first ejector 15 is supplied to the first evaporator 16 and the refrigerant on a first branch passage 18 side is supplied to the second evaporator 19, a cooling effect is caused simultaneously in the first and second evaporators 16 and 19. Therefore, the cold wind cooled by both of the first and second evaporators 16 and 19 is blown into the passenger compartment space 22 which is the cooling object space, and the passenger compartment space 22 is cooled.

At such time, the refrigerant evaporation pressure of the first evaporator 16 is a pressure after boosting by the diffuser part 15*d*, and, on the other hand, the outlet side of the second evaporator 19 is connected to the refrigerant suction port 15*b* of the first ejector 15, thereby the lowest pressure just after the decompression by the nozzle part 15*a* is applied to the second evaporator 19.

Thereby, the refrigerant evaporation pressure (i.e., refrigerant evaporation temperature) of the second evaporator 19 is controlled to be lower than the refrigerant evaporation pressure (i.e., refrigerant evaporation temperature) of the first evaporator 16. Further, the first evaporator 16 having the high refrigerant evaporation temperature is disposed on the upstream side in the flow direction A of the blown air and the second evaporator 19 having the low refrigerant evaporation temperature is disposed on the downstream side in the flow direction A of the blown air, a temperature difference between the refrigerant evaporation temperature in the first evaporator 16 and the blown air and a temperature difference between the refrigerant evaporation temperature in the second evaporator 19 and the blown air are both securely reserved.

For this reason, the cooling capacity of both of the first and second evaporators 16 and 19 is effectively achieved. Therefore, the cooling performance for the passenger compartment space 22 which is a common cooling object space can be effectively achieved by the combination of the first and second evaporators 16 and 19.

Further, since the first and second evaporators 16 and 19 are combined as one evaporator unit 20, while being able to pack the first and second evaporators 16 and 19 into a one small unit structure, an assemble work for installing the one evaporator unit 20 into a unit case (not shown) is easily performed at one stroke.

On the other hand, since the inner space of the in-vehicle refrigerator (not shown) is cooled by the third evaporator 27 provided in the second branch passage 22, a separate cooling object space in an inside of the in-vehicle refrigerator is independently cooled by the third evaporator 27.

Since the first ejector 15 is disposed exclusively for the evaporator unit 20 that is made from the first and second evaporators 16 and 19, and the second ejector 24 is disposed exclusively for the third evaporator 27, it is easy to appropriately adjust the refrigerant flow amount of the evaporator unit 20 and the refrigerant flow amount of the third evaporator 27 respectively by the exclusive ejectors, and a high cooling capacity is achieved for both of the evaporator unit 20 and the third evaporator 27.

Figure 25:
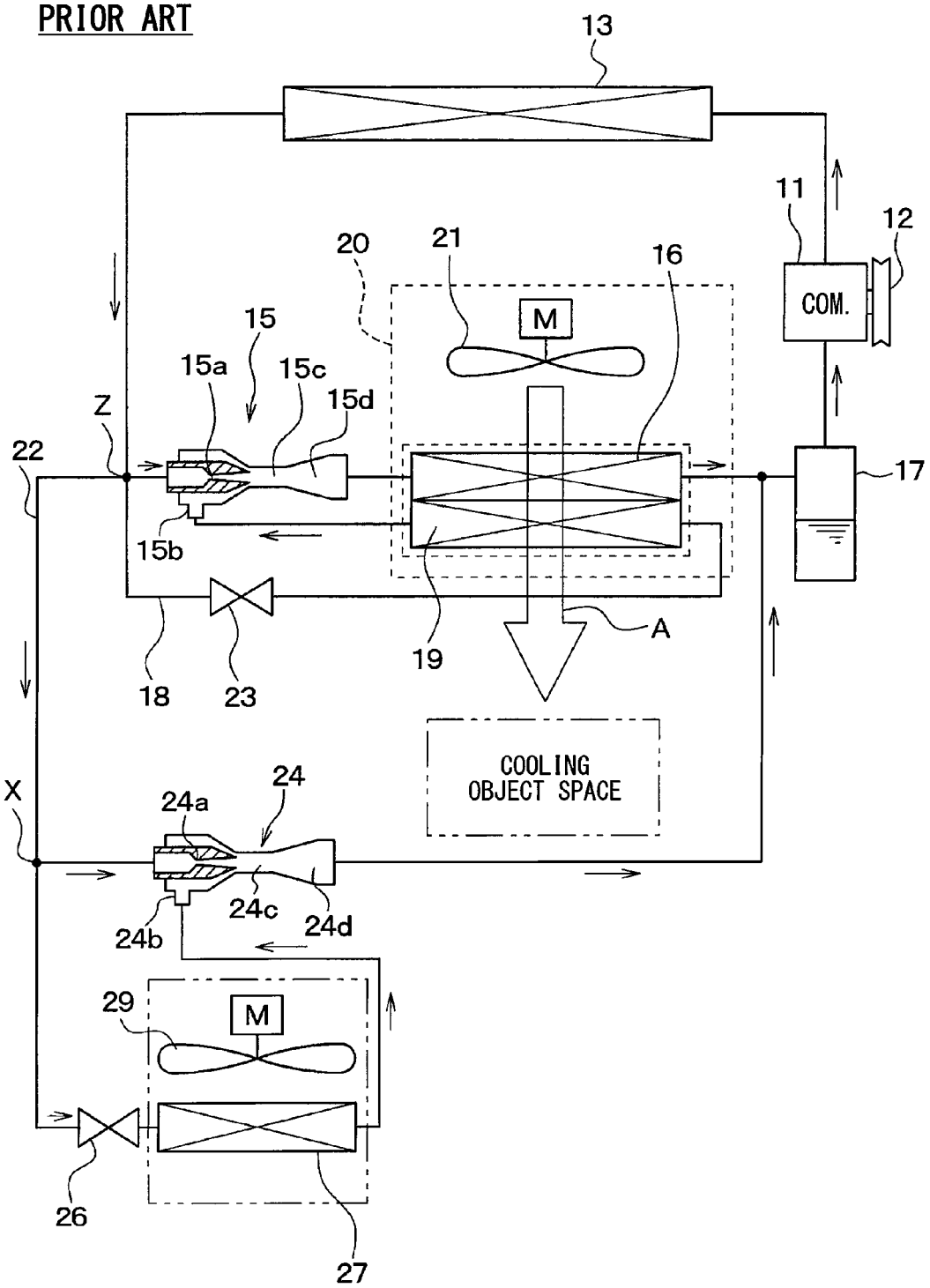
FIG. 25 PRIOR ART
FIG. 25 is a cycle configuration diagram of an ejector-type refrigeration cycle device in a conventional art.

Further, since the refrigerant to the third evaporator 27 branches on the downstream side of the second ejector 24 according to the present embodiment, the refrigerant flow amount in the second ejector 24 is increased in comparison to the conventional technique shown in FIG. 25 in which the refrigerant is branched to a second ejector 24 side and to a third evaporator 25 side on the upstream side of the second ejector 24. For this reason, the second ejector 24 may have a larger size as compared with the above-mentioned conventional technique, manufacturing of the second ejector 24 is made easy.

Further, according to the present embodiment, the refrigerant flow amount flowing out from the refrigerant outlet 26*c* is decreased by swirling the refrigerant with the throttle mechanism 26 as mentioned above.

Figure 6:
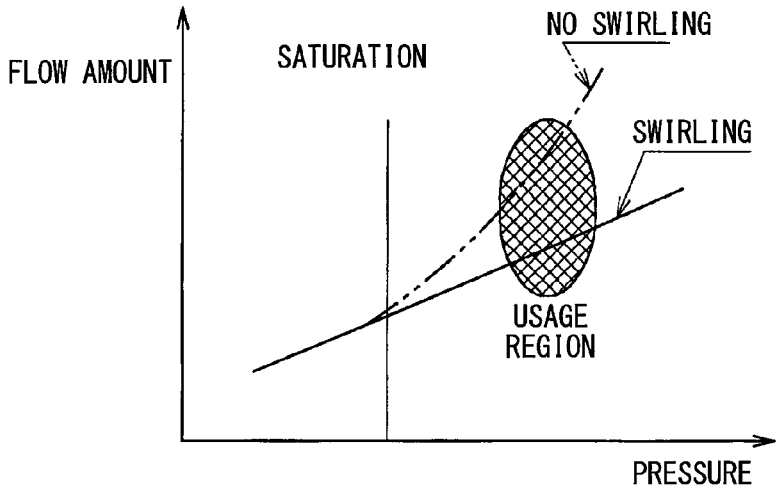
FIG. 6 is a graph showing a refrigerant flow-amount reduction effect in the throttle mechanism in the first embodiment.

FIG. 6 shows a graph which illustrates a flow amount reduction effect by swirling the refrigerant, which shows a comparison between a swirl case and a non-swirl case with the same throttle diameter. As shown in FIG. 6, in a usage region of the throttle mechanism 26 of the present embodiment, the swirl case has a smaller flow amount than the non-swirl case where no swirl is caused. For this reason, the refrigerant flow amount flowing into the third evaporator 25 is optimally adjustable.

Further, when no swirl is caused, it is necessary to have a smaller flow amount by making the device to have a smaller size, thereby making it difficult to manufacture the device, and also making the device more prone to clogging of foreign matter. That is, for the same flow amount, the swirl case allows a larger device volume than the non-swirl case, thereby making it easier to manufacture the device, and also making the device to be clog-free.

Second Embodiment

Figure 7:
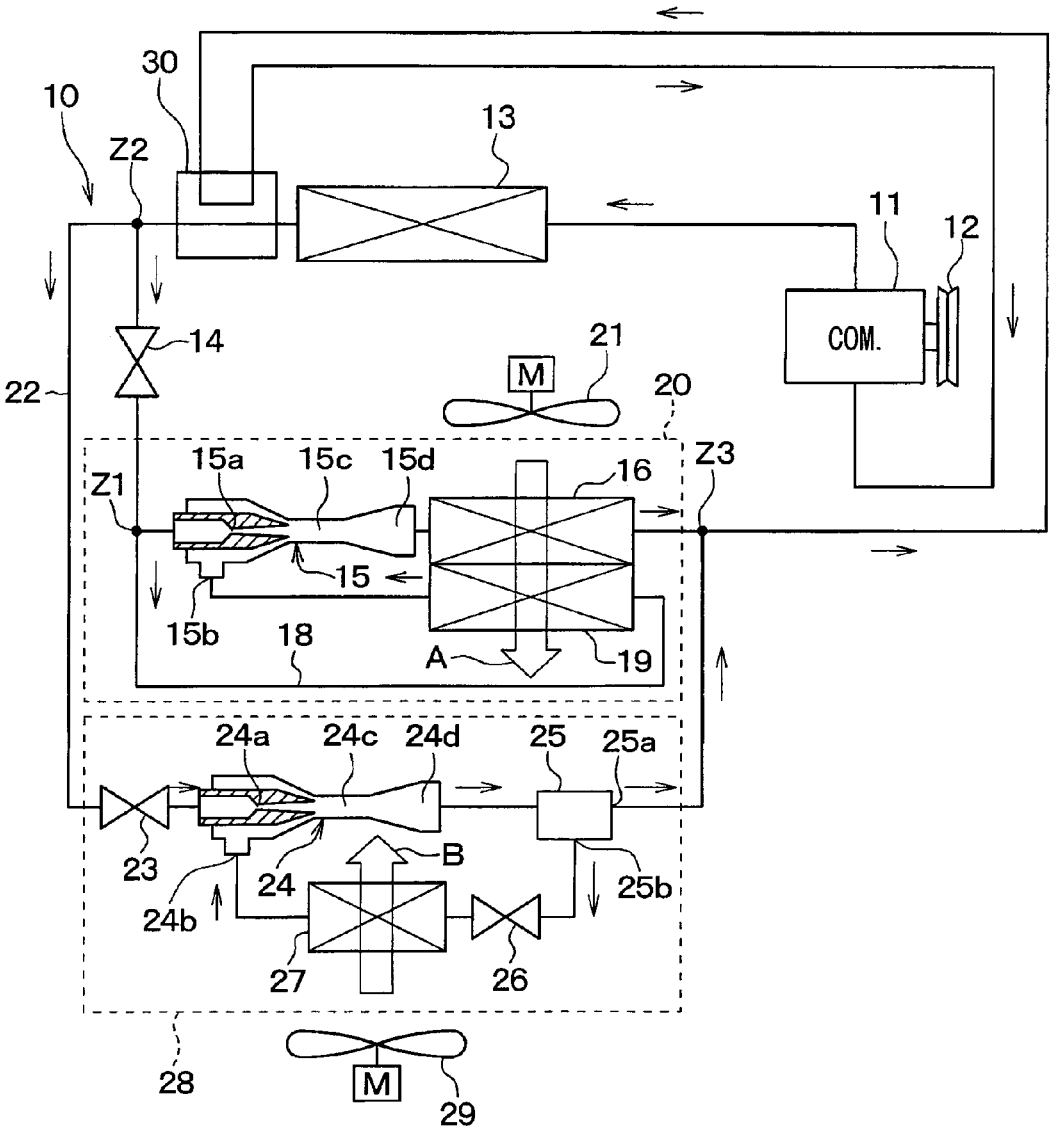
FIG. 7 is a cycle configuration diagram of an ejector-type refrigeration cycle device in a second embodiment.

According to the second embodiment, as shown in FIG. 7, an internal heat exchanger 30 is added to the first embodiment described above, and the gas-liquid separator 17 is removed therefrom.

The internal heat exchanger 30 provides a heat exchange function which exchanges heat between the high pressure refrigerant flowing out from the radiator 13 and the low pressure refrigerant (i.e., a gas-liquid two phase refrigerant) that has passed through the merge part Z3. Therefore, the high pressure refrigerant flowing out from the radiator 13 is cooled by the internal heat exchanger 30, and the low pressure refrigerant (i.e., a gas-liquid two phase refrigerant) that has passed through the merge part Z3 absorbs heat in the internal heat exchanger 30 to become a gas phase refrigerant. Therefore, the gas-liquid separator 17 of the first embodiment described above can be removed.

Also, in the present embodiment, the refrigerant distributor 25 may comprise an accumulator in which a direction of swirl of the refrigerant flowing therein may be configured to have a right angle against (i.e., may be perpendicular to) the inflow direction of the refrigerant flowing into the accumulator, just like the first embodiment. The other portions may have the same configuration as the first embodiment.

Third Embodiment

Figure 8:
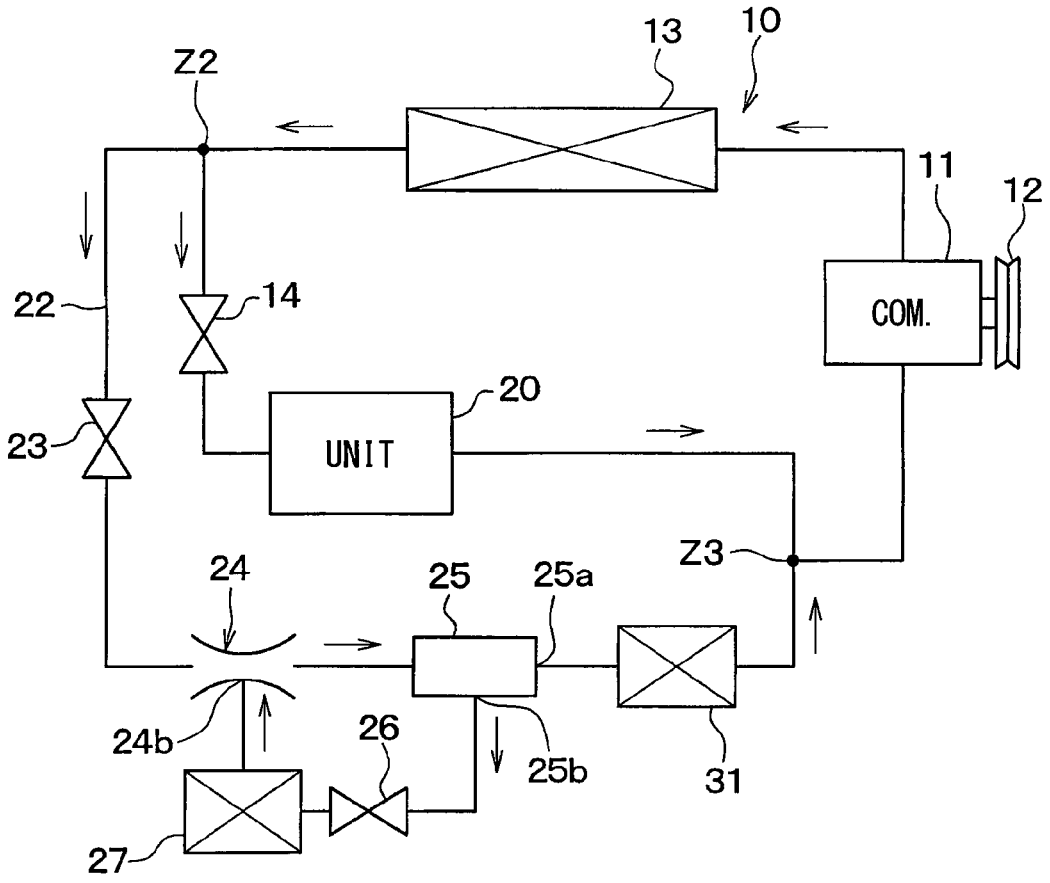
FIG. 8 is a cycle configuration diagram of an ejector-type refrigeration cycle device in a third embodiment.

According to the third embodiment, as shown in FIG. 8, a fourth evaporator 31 is added to the first embodiment described above, and the gas-liquid separator 17 is removed.

The fourth evaporator 31 is disposed at a position between the refrigerant distributor 25 and the merge part Z3. The high dryness refrigerant flowing out from the refrigerant distributor 25 evaporates in the fourth evaporator 31, and becomes a gas phase refrigerant. Therefore, the gas-liquid separator 17 of the first embodiment described above can be removed.

As a use purpose of the fourth evaporator 31, cooling of the passenger compartment space for assisting the first and second evaporators 16 and 19 and/or cooling of the inside space of the in-vehicle refrigerator for assisting the third evaporator 27 may be considered, for example. The other portions may have the same configuration as the first embodiment.

Figure 9:
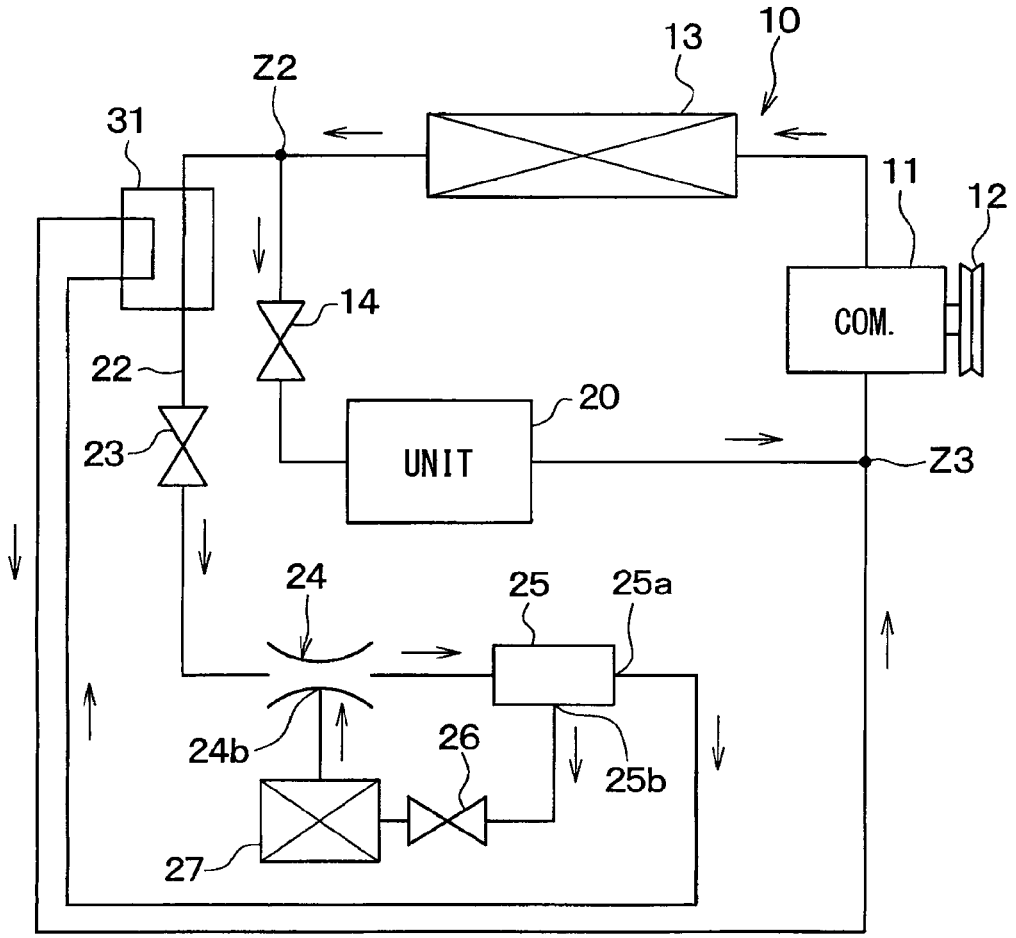
FIG. 9 is a cycle configuration diagram of an ejector-type refrigeration cycle device in a first modification of the third embodiment.

Further, as shown in FIG. 9, the fourth evaporator 31 may be used as an internal heat exchanger. In the example of FIG. 9, the fourth evaporator 31 is configured to exchange heat between the high pressure refrigerant which branched at the branch part Z2 to the second branch passage 22 and the low pressure refrigerant flowing out from the refrigerant distributor 25. However, the fourth evaporator 31 may exchange heat between the high pressure refrigerant flowing out from the radiator 13 and the low pressure refrigerant flowing out from the refrigerant distributor 25.

Figure 10:
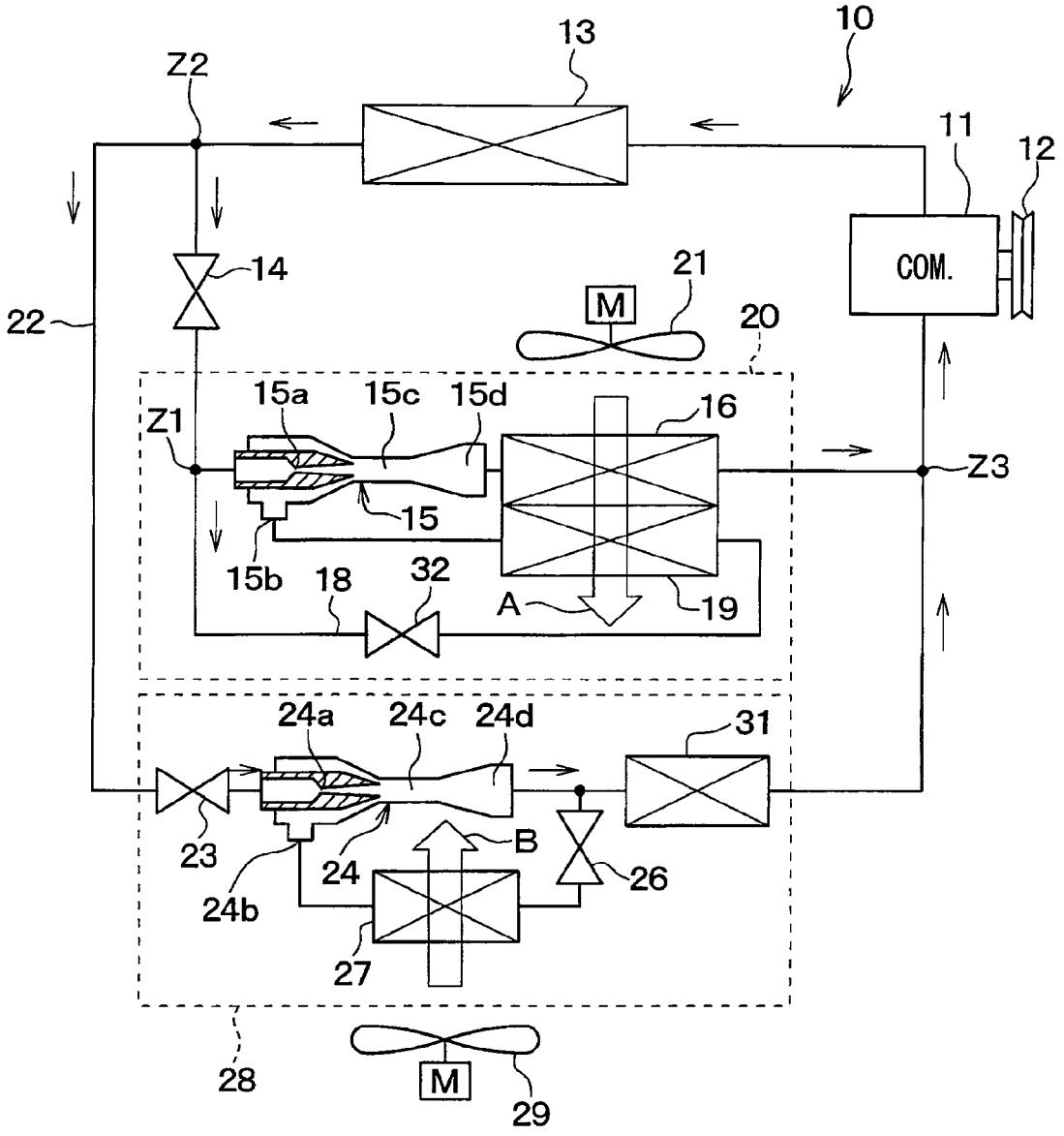
FIG. 10 is a cycle configuration diagram of an ejector-type refrigeration cycle device in a second modification of the third embodiment.

Further, as shown in FIG. 10, by removing the refrigerant distributor 25 in FIG. 8, the refrigerant flowing out from the second ejector 24 may be split into two, i.e., to a throttle-mechanism 26 side and to a fourth evaporator 31 side, without performing a gas-liquid separation of the refrigerant.

Further, in an example of FIG. 10, a throttle mechanism 32 is disposed at a position between the branch part Z1 and the second evaporator 19. Further, in the example of FIG. 10, the fourth evaporator 31 is integrated with the third evaporator 27, the second ejector 24, the refrigerant distributor 25, and the throttle mechanism 26 to have one body as the evaporator unit 28.

Fourth Embodiment

Figure 11:
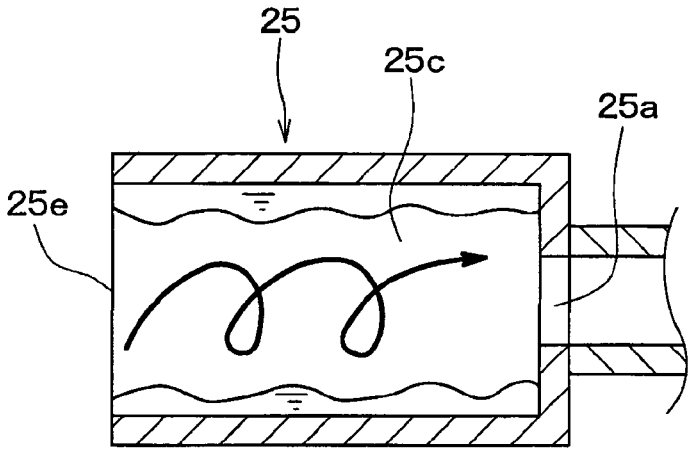
FIG. 11 is a sectional view of a refrigerant distributor in a fourth embodiment.

Although the refrigerant distributor 25 has the liquid pool part 25*d* which pools the liquid-phase refrigerant separated at the swirl part 25*c* in the first embodiment described above, the refrigerant distributor 25 may be configured differently, that is, as shown in FIG. 11, the liquid pool part may be dispensed with and a liquid film formed on an inside of the wall of the swirl part 25*c* may be guided to flow out as it is in the fourth embodiment. The other portions may have the same configuration as the first embodiment.

Fifth Embodiment

Figure 12:
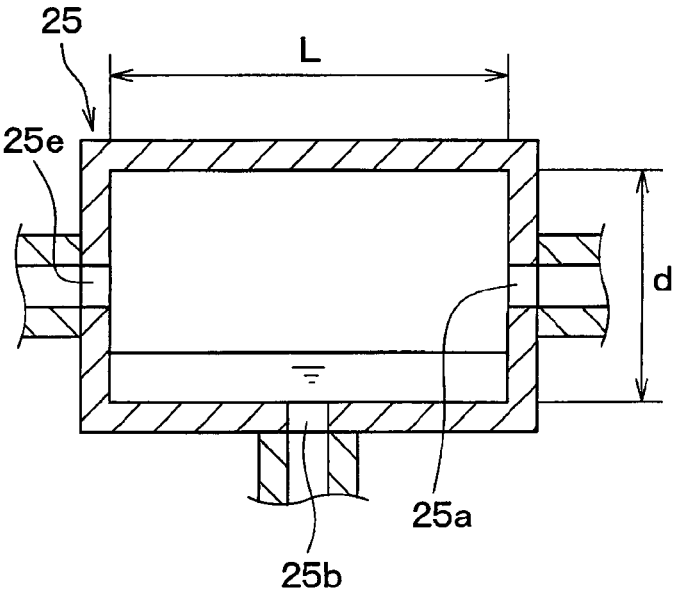
FIG. 12 is a sectional view of a refrigerant distributor in a fifth embodiment.

According to the first embodiment described above, the refrigerant distributor 25 separates gas and liquid by swirling the refrigerant. However, in the fifth embodiment, the refrigerant distributor 25 may separate gas and liquid by utilizing the gravity as shown in FIG. 12, without causing a swirl. That is, by increasing a ratio L/d between a total length L of the refrigerant distributor 25 and an inner diameter d, gas and liquid are separated due to the difference of their specific gravities. The other portions may have the same configuration as the first embodiment.

Sixth Embodiment

Figure 13:
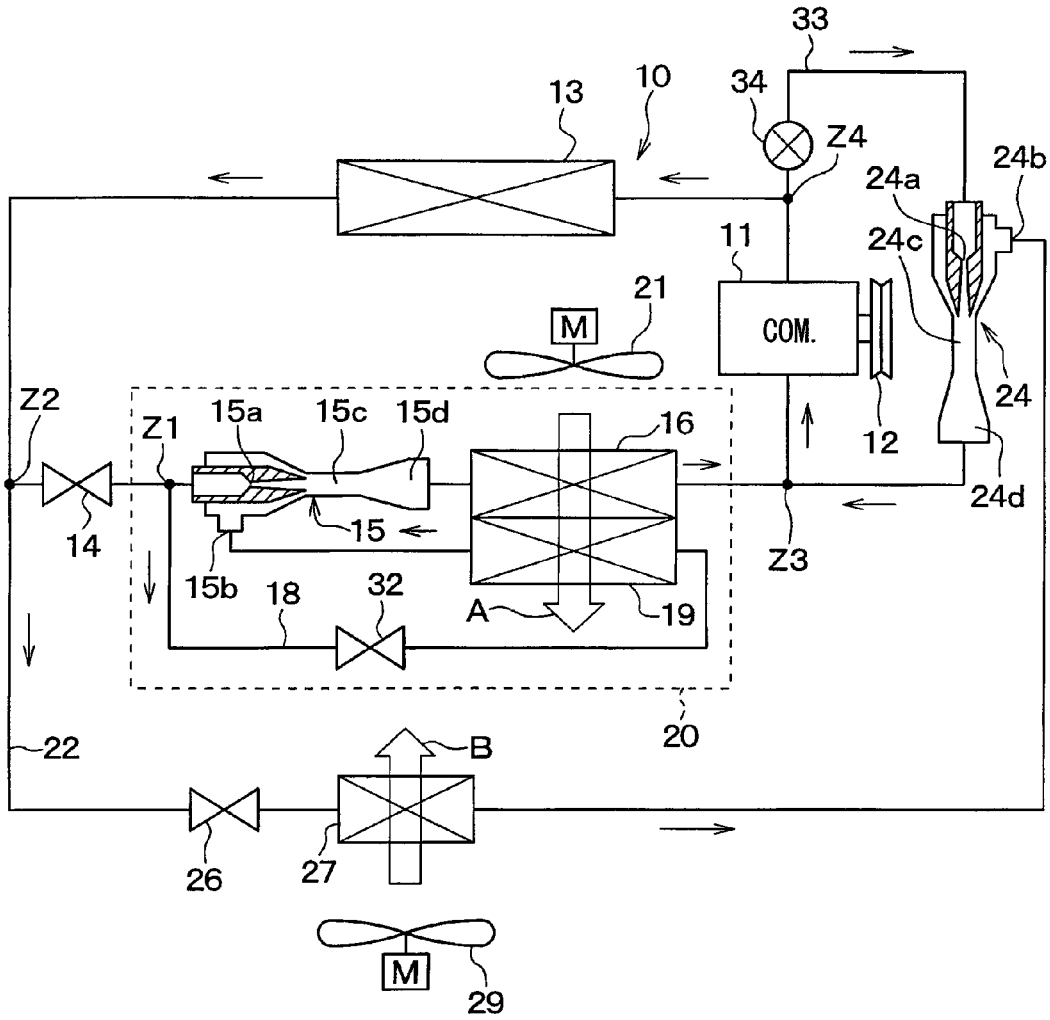
FIG. 13 is a cycle configuration diagram of an ejector-type refrigeration cycle device in a sixth embodiment.

In the above-mentioned embodiment, an intermediate pressure refrigerant (i.e., a gas-liquid two phase refrigerant) flows into the second ejector 24. However, in the sixth embodiment, as shown in FIG. 13, it is configured that a gas phase refrigerant flows into the second ejector 24.

More specifically, a third branch passage 33 branches from a branch part Z4 positioned between the compressor 11 and the radiator 13, and a downstream side of the third branch passage 33 is connected to the merge part Z3. The second ejector 24 is disposed in the third branch passage 33. Further, an open-close valve 34 which opens and closes the third branch passage 33 is also disposed in the third branch passage 33.

The downstream side of the second branch passage 22 is connected to the refrigerant suction port 24*b* of the second ejector 24. In the second branch passage 22, the throttle mechanism 26 and the third evaporator 27 are disposed.

Figure 14:
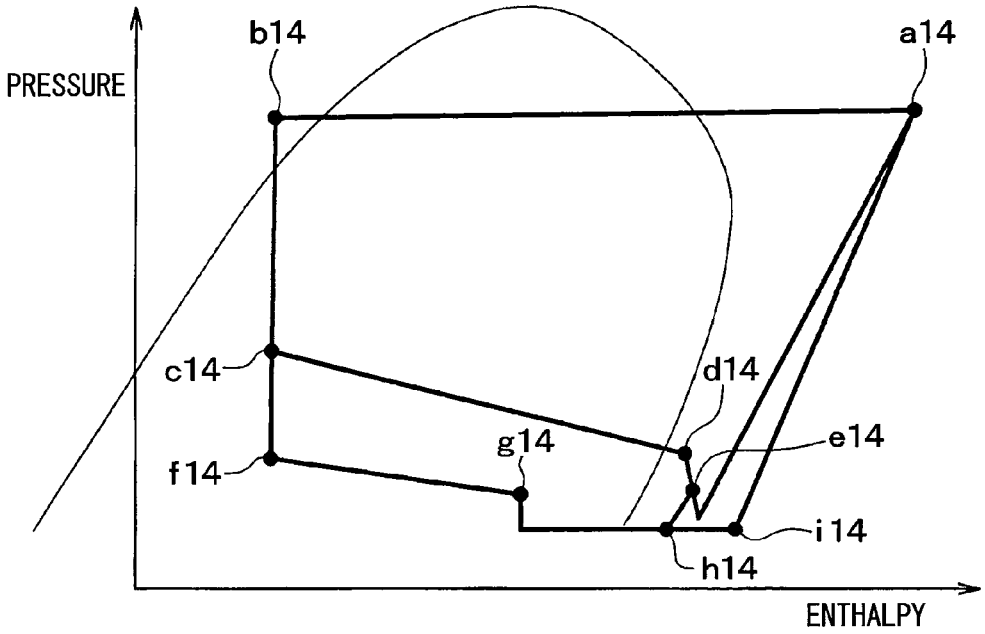
FIG. 14 is a Mollier diagram showing refrigerant states in the refrigerant cycle device in the sixth embodiment.

The operation of the present embodiment is explained based on the Mollier diagram of FIG. 14. When the compressor 11 is driven by the vehicle engine, the compressor 11 draws the refrigerant, and discharges the refrigerant after compressing the refrigerant to be the high pressure refrigerant. The gas phase refrigerant in a high temperature and high pressure state discharged from the compressor 11 is split at the branch part Z4 into a refrigerant flow toward the radiator 13 and a refrigerant flow toward the second ejector 24. The refrigerant flow having high temperature from the branch part Z4 toward the radiator 13 is cooled by the outer air in the radiator 13 and is condensed (i.e., the 14 point→the b14 point). The high pressure liquid phase refrigerant flowing out from the radiator 13 is split at the branch part Z2 into a refrigerant flow toward the throttle mechanism 14 and a refrigerant flow toward the second branch passage 22.

The refrigerant flow which flows toward the throttle mechanism 14 from the branch part Z2 is decompressed by the throttle mechanism 14, and becomes an intermediate pressure refrigerant, and this intermediate pressure refrigerant is split at the branch part Z1 into a refrigerant flow toward the first ejector 15 and a refrigerant flow toward the first branch passage 18, and the refrigerant flow flowing into the first ejector 15 is decompressed by the nozzle part 15*a* and expands (i.e., the b14 point→the c14 point).

Therefore, a pressure energy of the refrigerant is converted to a speed energy by the nozzle part 15*a*, and the refrigerant is jetted from the jetting opening of the nozzle part 15*a* at high speed. Due to the fall of the refrigerant pressure fall at such time, the refrigerant that has passed through the second evaporator 19 in the first branch passage 18 is drawn from the refrigerant suction port 15*b*.

The refrigerant jetted from the nozzle part 15*a* and the refrigerant drawn by the refrigerant suction port 15*b* are mixed by the mixing part 15*c* on a downstream side of the nozzle part 15*a*, and flow into the diffuser part 15*d*. In the diffuser part 15*d*, by the expansion of the passage area size, a speed (i.e., expansion) energy of the refrigerant is converted to a pressure energy, thereby the pressure of the refrigerant increases.

Then, the refrigerant flowing out from the diffuser part 15*d* of the first ejector 15 passes through the first evaporator 16. In the first evaporator 16, a low temperature and low pressure refrigerant absorbs heat from the blown air that flows along the arrow A direction, and evaporates (i.e., the c14 point→the d14 point).

The refrigerant which has passed the first evaporator 16 joins the gas phase refrigerant flowing out from the second ejector 24 at the merge part Z3 (i.e., the d14 point→the e14 point). The refrigerant which joined at the merge part Z3 is drawn by the compressor 11, and is compressed again (i.e., the e14 point→the a14 point). Further, as shown in FIG. 14, when the refrigerant is drawn by the compressor 11, the pressure fall of the refrigerant is caused (i.e., a suction pressure reduction).

On the other hand, the refrigerant flow which has flown into the first branch passage 18 is decompressed by the throttle mechanism 32, and becomes a low pressure refrigerant, and the low pressure refrigerant flows into the second evaporator 19. In the second evaporator 19, a low pressure refrigerant absorbs heat from the blown air flowing along the arrow A direction and evaporates (i.e., omitted from FIG. 14). The refrigerant after this evaporation is drawn into the first ejector 15 from the refrigerant suction port 15*b* (i.e., omitted from FIG. 14).

Further, the refrigerant flow which has been split at the branch part Z2 and has flown into the second branch passage 22 is decompressed by the throttle mechanism 26, and becomes a low pressure refrigerant (i.e., the b14 point→the f14 point), and the low pressure refrigerant flows into the third evaporator 27.

In the third evaporator 27, the low pressure refrigerant absorbs heat from the blown air B flowing from the electric blower 29, and evaporates (i.e., the f14 point→the g14 point). The refrigerant after this evaporation is drawn into the second ejector 24 from the refrigerant suction port 24*b* (i.e., the g14 point→the h14 point). The blown air B from which heat is absorbed and which has become a cold air in the third evaporator 27 is blown into the inner space of the in-vehicle refrigerator (not shown).

The gas phase refrigerant in a high temperature and high pressure state from the branch part Z4 to the second ejector 24 is decompressed by the nozzle part 24*a* of the second ejector 24, and expands (i.e., the a14 point→the i14 point). Therefore, a pressure energy of the refrigerant is converted to a speed energy by the nozzle part 24*a*, and the refrigerant is jetted from the nozzle part 24*a* at high speed. Due to the decrease of the refrigerant pressure in this case, the refrigerant that has passed through the third evaporator 27 is drawn from the refrigerant suction port 24*b*.

The refrigerant which is jetted from the nozzle part 24*a* and the refrigerant drawn by the refrigerant suction port 24*b* are mixed at the mixing part 24*c* on the downstream side of the nozzle part 24*a* and flow into the diffuser part 24*d* (i.e., the i14 point→the h14 point). In the diffuser part 24*d*, by an expansion of the passage area size, a speed (i.e., expansion) energy of the refrigerant is converted to a pressure energy, thereby raising the pressure of the refrigerant.

Then, the refrigerant flowing out from the diffuser part 24*d* joins the refrigerant which has passed through the first evaporator 16 at the merge part Z3 (i.e., the h14 point→the e14 point). The joined refrigerant which has joined at the merge part Z3 is drawn by the compressor 11, and is compressed again (i.e., the e14 point→the a14 point).

Since the refrigerant which flows in the second ejector 24 is a gas phase refrigerant having low density according to the present embodiment, the size of the second ejector 24 is made larger in comparison to a case in which a liquid phase refrigerant having high density flows in the second ejector 24. Therefore, manufacturing of the second ejector 24 is made easy.

Seventh Embodiment

Figure 15:
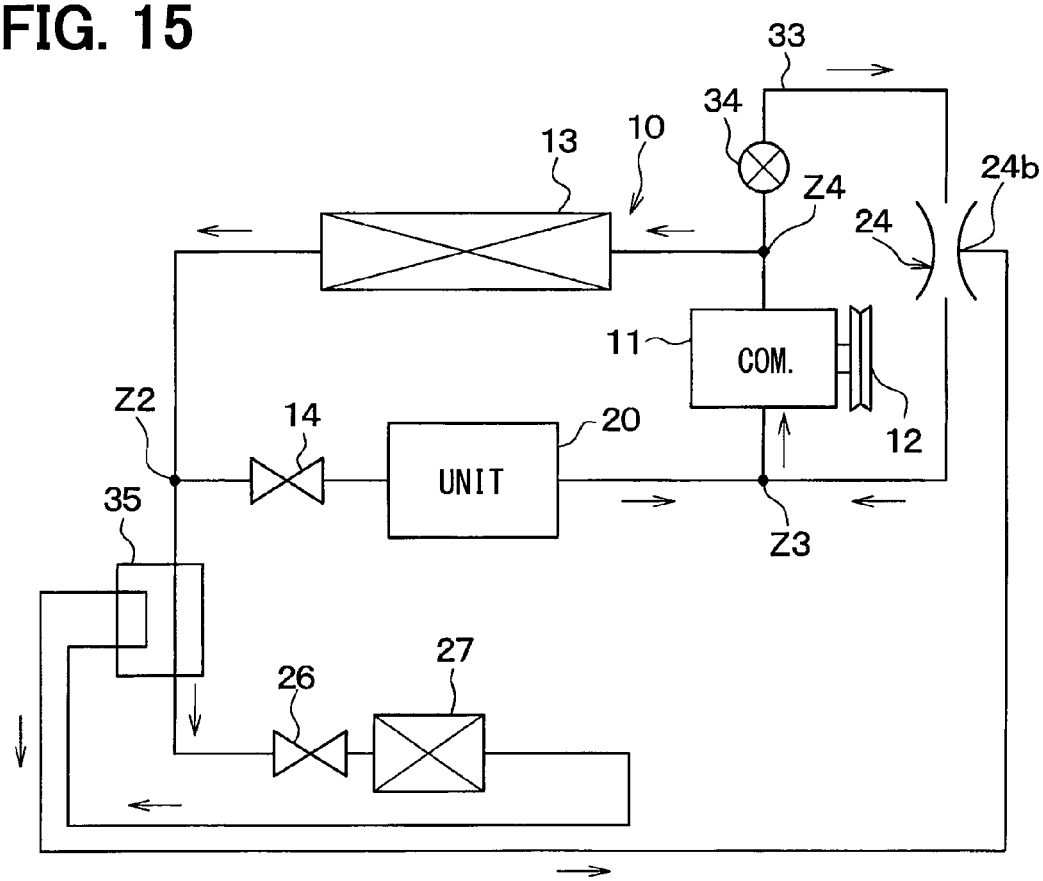
FIG. 15 is a cycle configuration diagram of an ejector-type refrigeration cycle device in a seventh embodiment.

According to the seventh embodiment, as shown in FIG. 15, an internal heat exchanger 35 is added to the sixth embodiment described above.

The internal heat exchanger 35 provides a function which exchanges heat between the high pressure refrigerant which flows from the branch part Z2 toward the throttle mechanism 26 and the low pressure refrigerant (i.e., a gas-liquid two phase refrigerant) that has passed through the third evaporator 27. Therefore, the high pressure refrigerant which flows from the branch part Z2 toward the throttle mechanism 26 is cooled by the internal heat exchanger 35, and the low pressure refrigerant (i.e., a gas-liquid two phase refrigerant) that has passed through the third evaporator 27 absorbs heat in the internal heat exchanger 35, and becomes a gas phase refrigerant.

Further, the internal heat exchanger 35 may also be configured to provide a function that exchanges heat between the high pressure refrigerant which flows from the radiator 13 to the branch part Z2 and the low pressure refrigerant (i.e., a gas-liquid two phase refrigerant) that has passed through the third evaporator 27.

Figure 16:
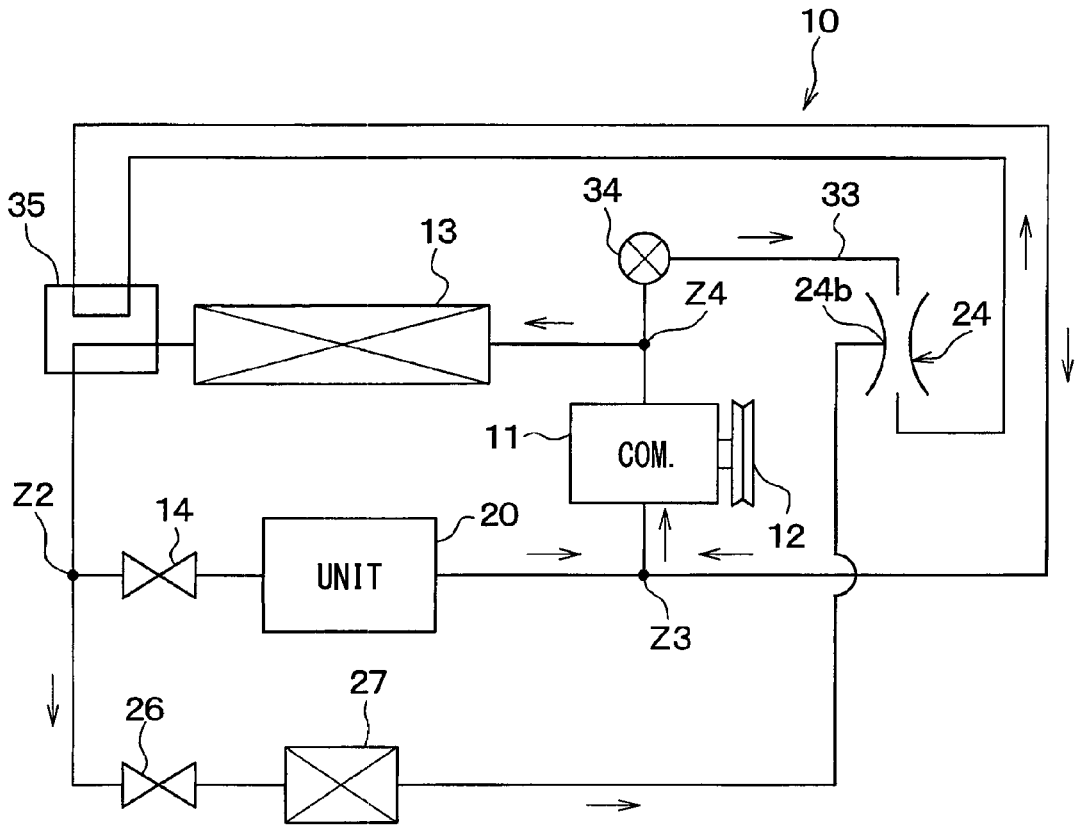
FIG. 16 is a cycle configuration diagram of an ejector-type refrigeration cycle device in a first modification of the seventh embodiment.

Further, as shown in FIG. 16, the internal heat exchanger 35 may also be configured to provide a function that exchanges heat between the high pressure refrigerant flowing from the radiator 13 to the branch part Z2 and the low pressure refrigerant that has passed through the second ejector 24.

Figure 17:
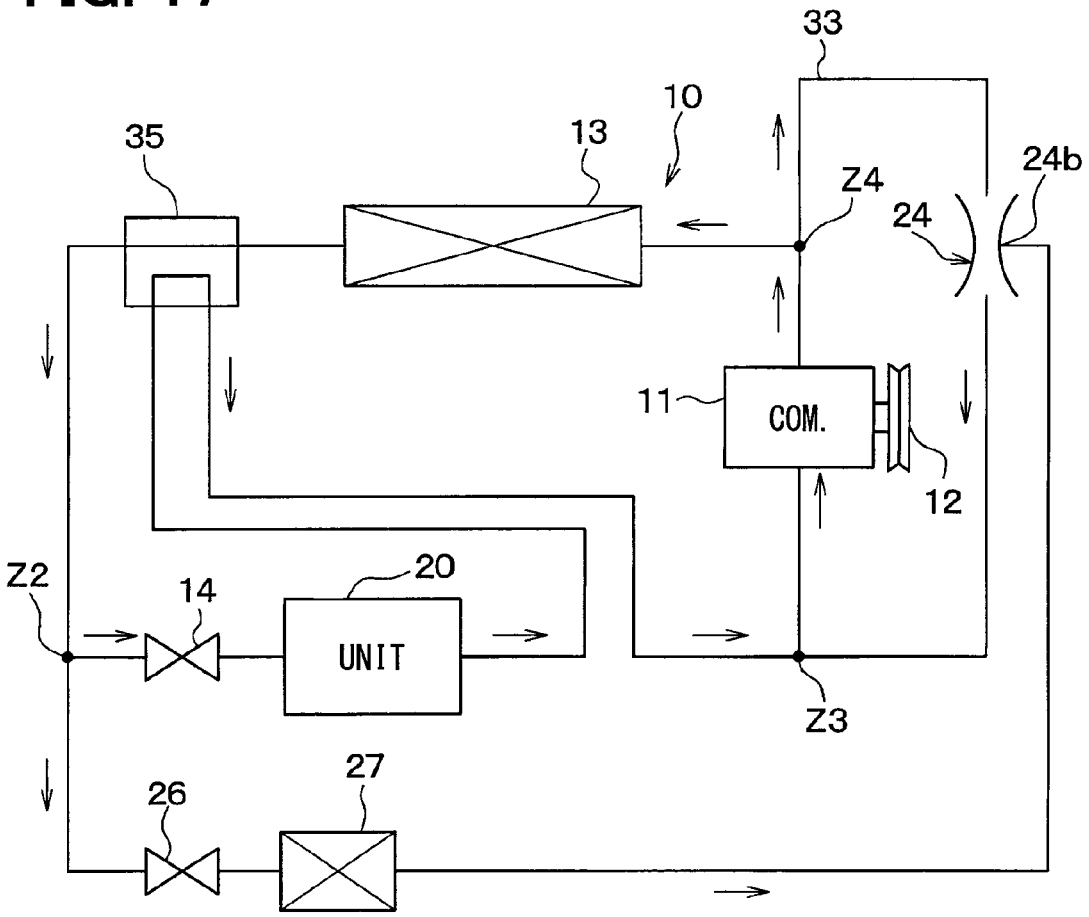
FIG. 17 is a cycle configuration diagram of an ejector-type refrigeration cycle device in a second modification of the seventh embodiment.

Further, as shown in FIG. 17, the internal heat exchanger 35 may also provide a function that exchanges heat between the high pressure refrigerant flowing from the radiator 13 to the branch part Z2 and the low pressure refrigerant that has passed through the evaporator unit 20. Further, the other portions may have the same configuration as the first embodiment.

Eighth Embodiment

According to the above-mentioned embodiment, the second ejector 24 has a double cylinder structure, and the drive flow Gn flows through a flow passage formed in an inside of the inner cylinder 241 and the suction flow Ge flows through a flow passage formed between the inner cylinder 241 and the outer cylinder 242. However, according to the eighth embodiment, as shown in FIG. 18, the suction flow Ge flows through a flow passage formed in an inside of the inner cylinder 241 of the second ejector 24 that has the double cylinder structure, and the drive flow Gn flows through a flow passage formed in a space between the inner cylinder 241 and the outer cylinder 242.

The inner cylinder 241 has a constant outer diameter. The outer cylinder 242 has a tapered part in which the inner diameter is gradually decreased from the upstream side toward the downstream side along the refrigerant flow, a throttle part that is formed at a tip of the tapered part at which the inner diameter is decreased to the minimum, and a widening part in which the inner diameter gradually expands toward the downstream side of the refrigerant flow from the throttle part. Thereby, the nozzle part 24*a* formed by the outer cylinder 242 can be used as a Laval nozzle.

Figure 18:
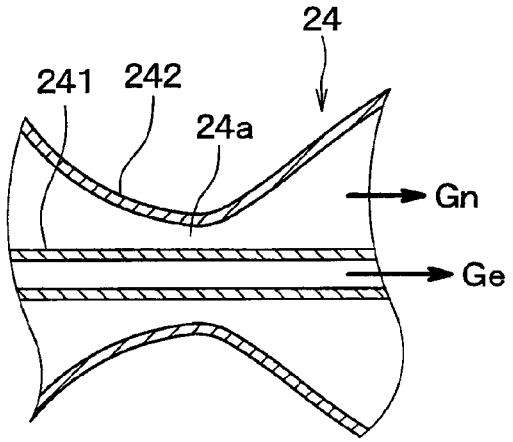
FIG. 18 is a sectional view of a second ejector in an eighth embodiment.
Figure 19:
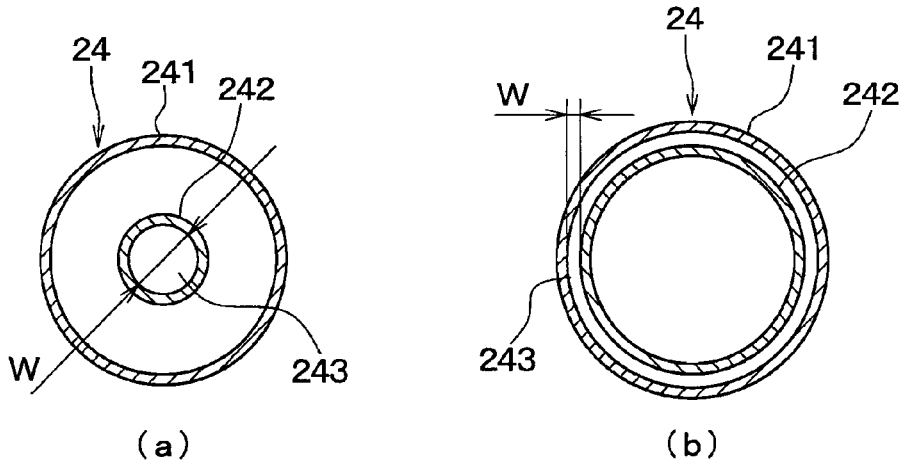
FIG. 19 (*a*) is a sectional view of the second ejector in FIG. 18, and FIG. 19 (*b*) is a sectional view of the second ejector in FIG. 2.

FIG. 19 (*a*) is a sectional view which cuts the second ejector 24 of FIG. 18 in a direction which intersects perpendicularly with an axial direction of the ejector 24, and FIG. 19 (*b*) is a sectional view which cuts the second ejector 24 of FIG. 2 in a direction which intersects perpendicularly with an axial direction of the ejector 24.

In the second ejector 24 of the present embodiment shown in FIG. 19 (*a*), even though the cross-section area size of a flow passage 243 through which the suction flow Ge flows is the same as the ejector 24 in FIG. 19 (*b*), a width dimension W of the flow passage 243 is expandable in comparison to the ejector 24 in FIG. 19 (*b*). Therefore, manufacturing of the second ejector 24 is made easy.

Figure 20:
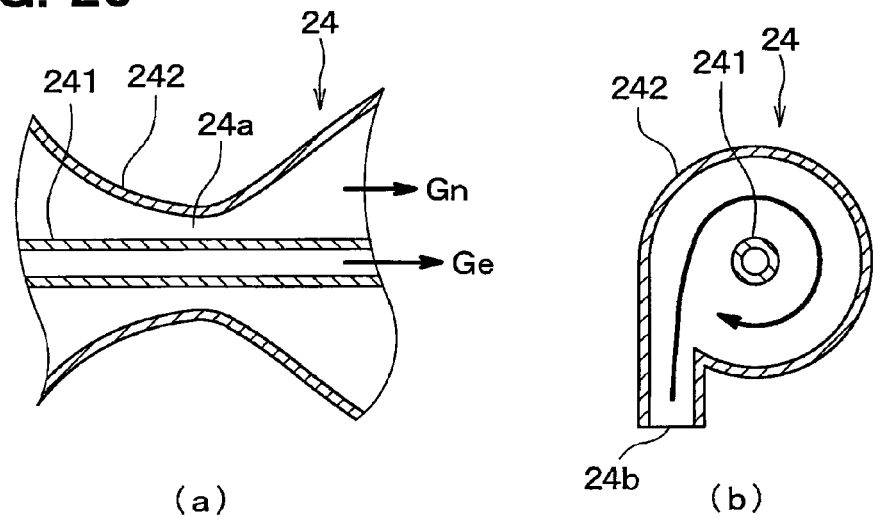
FIGS. 20 (*a*) and (*b*) are sectional views of a second ejector in a first modification of the eighth embodiment.

In an example of FIG. 20, the second ejector 24 has the refrigerant suction port 24*b* which is configured to guide the drive flow Gn in an eccentric direction and in a tangent direction relative to the outer cylinder 242. Thereby, the drive flow Gn is swirled in the nozzle part 24*a*.

By swirling the drive flow Gn in the nozzle part 24*a*, a gas-liquid separation of the drive flow Gn is performed by the centrifugal force, and a liquid film is formed on an inner wall at a throttle part of the nozzle part 24*a*. Thereby, the liquid film at the throttle part serves as a start point of boiling of the drive flow Gn, for promoting the boiling. The promoted boiling at the throttle part causes an atomization of liquid drops, and, with the gas refrigerant generated by the promoted boiling, the atomized liquid drops are accelerated. As a result, a nozzle efficiency is improved and the pressure of the second ejector 24 increases. In such case, the nozzle efficiency is defined as an energy conversion efficiency at the time of converting a pressure energy of the refrigerant to a kinetic energy in the nozzle part.

Figure 21:
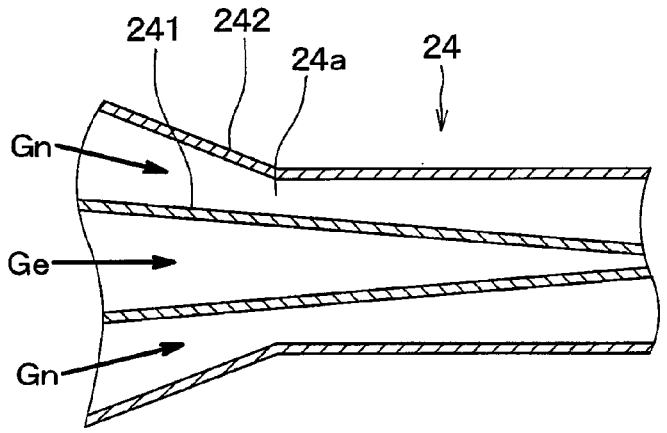
FIG. 21 is a sectional view of a second ejector in a second modification of the eighth embodiment.

In an example of FIG. 21, the inner cylinder 241 has a tapered cylindrical shape in which an outer diameter reduces gradually toward the flow direction of the refrigerant. In this case, even when a portion of the outer cylinder 242 is extended toward the downstream side of the refrigerant flow from the throttle part in a constant minimum inner diameter, the nozzle part 24*a* can still serve as a Laval nozzle.

Ninth Embodiment

Figure 22:
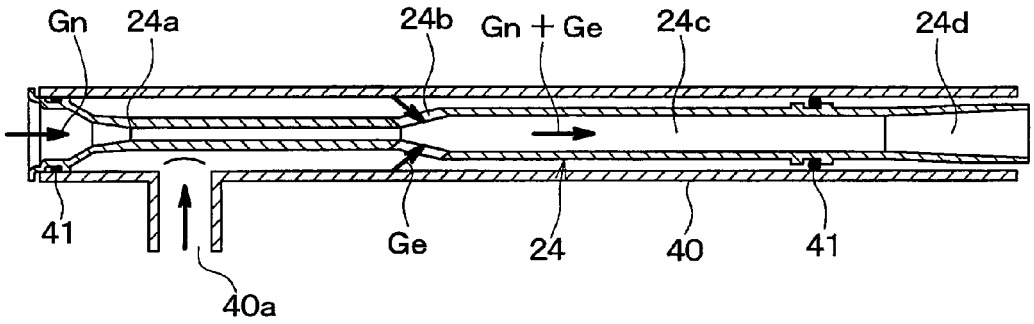
FIG. 22 is a sectional view of a second ejector in a ninth embodiment.

Although the second ejector 24 has a double cylinder structure in the above embodiment, the second ejector 24 may be formed, as shown in FIG. 22, as a single cylindrical member in the ninth embodiment. In an example of FIG. 22, the second ejector 24 is accommodated in an ejector tank 40.

The second ejector 24 is formed as a cylindrical member, on one end of which the nozzle part 24*a* is formed, and the mixing part 24*c* and the diffuser part 24*d* are formed in other part thereof, and the nozzle part 24*a* and mixing part 24*c* are connected smoothly, and the refrigerant suction port 24*b* is formed at a smoothly connecting portion which smoothly connects the nozzle part 24*a* and the mixing part 24*c*.

Since the nozzle part 24*a* and mixing part 24*c* are connected smoothly, the flow passage sectional area size changes continuously between the nozzle part 24*a* and the mixing part 24*c*. Thereby, a swirl loss is reduced.

Further, the ejector tank 40 is a cylindrical member in which both ends are opened, and an inlet 40*a* is formed on a side of the tank 40 for drawing the suction refrigerant Ge. At a position between an outer circumferential surface of the second ejector 24 and an inner circumferential surface of the ejector tank 40, an O ring 41 for preventing a leakage of the suction refrigerant Ge toward an outside is disposed.

Figure 23:
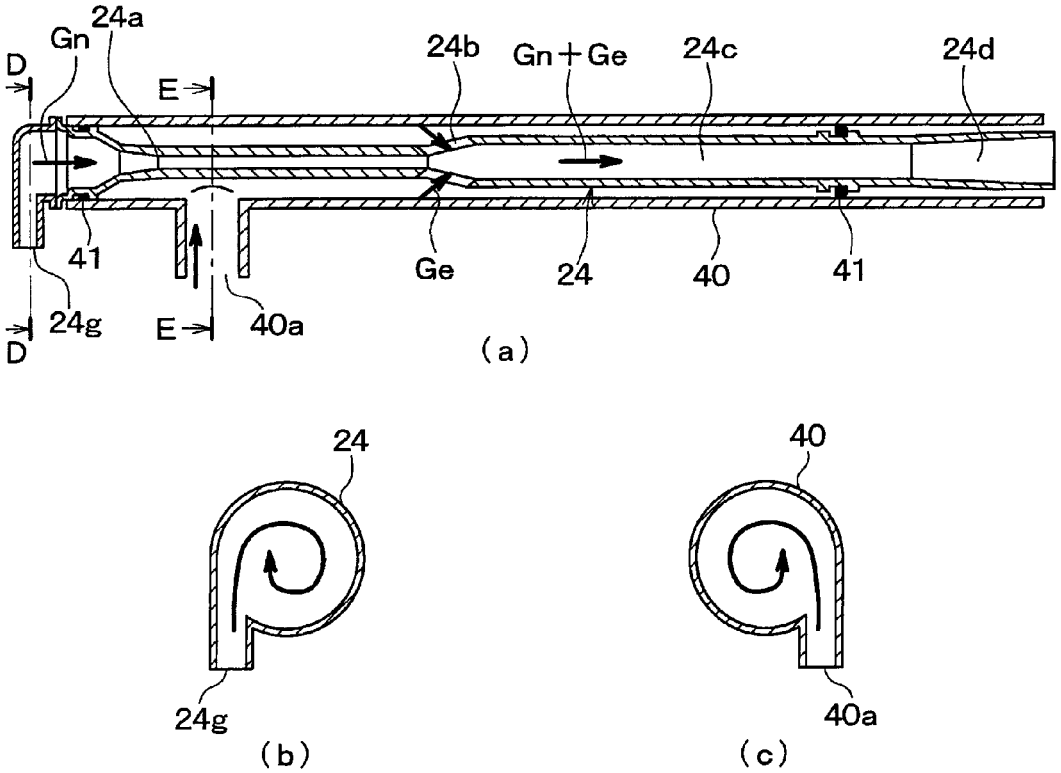
FIGS. 23 (*a*), (*b*), and (*c*) are sectional views of a second ejector in a modification of the ninth embodiment.

FIG. 23 is a modification of the present embodiment, in which the drive flow Gn which flows into the nozzle part 24*a* of the second ejector 24 is swirled, and the suction flow Ge which flows from the refrigerant suction port 24*b* into the mixing part 24*c* is swirled in an opposite direction relative to a swirl direction of the drive flow Gn.

In an example of FIG. 23, an inlet 24*g* of the drive flow Gn and the inlet 40*a* of the suction flow Ge are formed to flow the drive flow Gn and the suction flow Ge in an eccentric direction and in a tangent direction into the second ejector 24.

By swirling the drive flow Gn in the nozzle part 24*a*, the gas-liquid separation of the drive flow Gn is performed by the centrifugal force, and a liquid film is formed on an inner wall of the throttle part of the nozzle part 24*a*, and a boiling of the drive flow Gn is promoted, and the nozzle efficiency is improved, and the pressure rise in the second ejector 24 is caused.

Further, since the suction flow Ge which flows into the mixing part 24*c* from the refrigerant suction port 24*b* is swirled in an opposite direction relative to the swirl direction of the drive flow Gn, swirling of the drive flow Gn in the mixing part 24*c* is canceled by the swirling of the suction flow Ge. As a result, the kinetic energy of swirling of the drive flow Gn can be utilized as a kinetic energy of straight movement.

Tenth Embodiment

Figure 24:
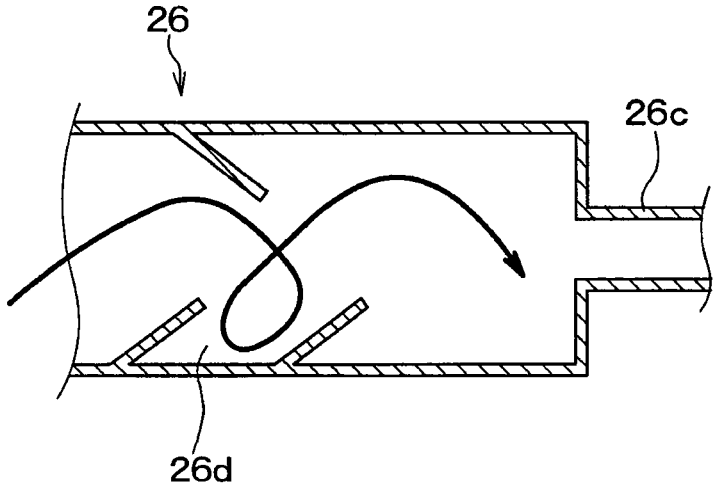
FIG. 24 is a sectional view of a throttle mechanism in a tenth embodiment.

Although the throttle mechanism 26 in the above embodiment is configured to swirl the refrigerant by having the refrigerant flow to flow along the tangent direction, a groove 26*d* in a spiral shape may be provided in the throttle mechanism 26, as illustratively shown in FIG. 24, for the swirling of the refrigerant.

Other Embodiments

Without being limited to the above-described embodiments, the present disclosure may have various changes and/or modifications as described below.

(1) Although the third evaporator 27 is used for cooling the inner space of the in-vehicle refrigerator in each of the above-mentioned embodiments, the use of the third evaporator 27 is not limited to the above. That is, the third evaporator 27 may also be used as the internal heat exchanger of a refrigeration cycle device, or as a device for cooling of an in-vehicle battery, or as a heat exchanger for cooling a seat air-conditioner, or the like.

(2) Although the refrigeration cycle device for vehicles is explained in each of the above-mentioned embodiments, the present embodiment may also be applicable, without being limited thereto, to a refrigeration cycle device for stationary use or the like.

(3) In each of the above-mentioned embodiments, what kind of refrigerant should be used is not specified. However, the refrigerant may be the one that is usable in both of the supercritical cycle and the subcritical cycle of steam compression type, such as a chloro-fluorocarbon type, a chloro-fluorocarbon alternative of HC type, a carbon dioxide (CO2), or the like.

Further, the chloro-fluorocarbon is a general term for representing an organic compound composed of carbon, fluoride, chlorine, and hydrogen in this case, and it is widely used as the refrigerant. The chloro-fluorocarbon type refrigerant includes an HCFC (i.e., a hydro-chloro-fluorocarbon) type refrigerant, an HFC (i.e., a hydro-fluorocarbon) type refrigerant, or the like, which are called as a chloro-fluorocarbon alternative due to their non-destructive characters for an ozone layer.

Further, the HC (hydrocarbon) type refrigerant includes hydrogen and carbon, and is a refrigerant material which exists in nature. The HC type refrigerant includes an R600a (i.e., isobutane), an R290 (i.e., propane), or the like.

(4) In each of the above-mentioned embodiments, a variable flow amount type ejector which can adjust a flow amount by adjusting the refrigerant flow passage area size of the nozzles 15*a* and 24*a* may be used as the first and second ejectors 15 and 24.

What is claimed is:

1. An ejector-type refrigeration cycle device comprising:

a compressor discharging a refrigerant;

a radiator which cools the refrigerant discharged from the compressor;

a first ejector and a second ejector, each of which draws the refrigerant from a refrigerant suction port by using a high-speed refrigerant flow jetted from a nozzle part;

a first suction-side evaporator connected to the refrigerant suction port of the first ejector; and a second suction-side evaporator connected to the refrigerant suction port of the second ejector, wherein a flow amount of the refrigerant in the second ejector is smaller than a flow amount of the refrigerant in the first ejector, the refrigerant branched at a branch part that is positioned on a downstream refrigerant side of the radiator and on an upstream refrigerant side of the first ejector flows into the second ejector, and the refrigerant branched on a downstream refrigerant side of the second ejector flows into the second suction-side evaporator.

2. The ejector-type refrigeration cycle device of claim 1, wherein the second ejector has a double cylinder structure which has an inner cylinder and an outer cylinder, a suction flow drawn from the refrigerant suction port flows through a flow passage formed in an inside of the inner cylinder, and a drive flow jetted from the nozzle part flows through a flow passage formed in a space between the inner cylinder and the outer cylinder.

3. The ejector-type refrigeration cycle device of claim 1, wherein the second ejector is configured such that the nozzle part of the second ejector is formed at one end portion of a cylindrical member, and a mixing part and a diffuser part of the second ejector are formed at an other end portion of the cylindrical member, wherein the mixing part mixes the high-speed refrigerant flow jetted from the nozzle part and a suction refrigerant drawn from the refrigerant suction port, the diffuser part reduces a speed of the refrigerant mixed in the mixing part and increases a pressure of the refrigerant mixed in the mixing part, and the nozzle part and the mixing part are connected smoothly.

4. The ejector-type refrigeration cycle device of any claim 1, further comprising:

a throttle mechanism decompressing the refrigerant which flows into the second suction-side evaporator, wherein the throttle mechanism has a structure swirling the refrigerant flowing therein.

5. An ejector-type refrigeration cycle device comprising:

a compressor discharging a refrigerant;

a radiator which cools the refrigerant discharged from the compressor;

a first ejector and a second ejector, each of which draws the refrigerant from a refrigerant suction port by using a high-speed refrigerant flow jetted from a nozzle part;

a first suction-side evaporator connected to the refrigerant suction port of the first ejector; and a second suction-side evaporator connected to the refrigerant suction port of the second ejector, wherein a flow amount of the refrigerant in the second ejector is smaller than a flow amount of the refrigerant in the first ejector, the refrigerant branched at a branch part that is positioned on a downstream refrigerant side of the compressor and on an upstream refrigerant side of the radiator flows into the second ejector, and the refrigerant branched on a downstream refrigerant side of the radiator and on an upstream refrigerant side of the first ejector flows into the second suction-side evaporator.

6. The ejector-type refrigeration cycle device of claim 5 wherein the second ejector has a double cylinder structure which has an inner cylinder and an outer cylinder, a suction flow drawn from the refrigerant suction port flows through a flow passage formed in an inside of the inner cylinder, and a drive flow jetted from the nozzle part flows through a flow passage formed in a space between the inner cylinder and the outer cylinder.

7. The ejector-type refrigeration cycle device of claim 5, wherein the second ejector is configured such that the nozzle part of the second ejector is formed at one end portion of a cylindrical member, and a mixing part and a diffuser part of the second ejector are formed at an other end portion of the cylindrical member, wherein the mixing part mixes the high-speed refrigerant flow jetted from the nozzle part and a suction refrigerant drawn from the refrigerant suction port, the diffuser part reduces a speed of the refrigerant mixed in the mixing part and increases a pressure of the refrigerant mixed in the mixing part, and the nozzle part and the mixing part are connected smoothly.

8. The ejector-type refrigeration cycle device of claim 5, further comprising:

a throttle mechanism decompressing the refrigerant which flows into the second suction-side evaporator, wherein the throttle mechanism has a structure swirling the refrigerant flowing therein.

* * * * *